US008068069B2

(12) United States Patent
Origuchi et al.

(10) Patent No.: US 8,068,069 B2
(45) Date of Patent: Nov. 29, 2011

(54) METHOD OF DRIVING PLASMA DISPLAY PANEL AND PLASMA DISPLAY APPARATUS

(75) Inventors: Takahiko Origuchi, Osaka (JP); Hidehiko Shoji, Osaka (JP); Mitsuo Ueda, Hyogo (JP)

(73) Assignee: Panasonic Corporation, Osaka (JP)

( * ) Notice: Subject to any disclaimer, the term of this patent is extended or adjusted under 35 U.S.C. 154(b) by 1056 days.

(21) Appl. No.: 11/913,815

(22) PCT Filed: Feb. 26, 2007

(86) PCT No.: PCT/JP2007/053506

§ 371 (c)(1),
(2), (4) Date: Nov. 7, 2007

(87) PCT Pub. No.: WO2007/099903

PCT Pub. Date: Sep. 7, 2007

(65) Prior Publication Data

US 2009/0091514 A1 Apr. 9, 2009

(30) Foreign Application Priority Data

Feb. 28, 2006 (JP) ..... 2006-051734

(51) Int. Cl.
*G09G 3/28* (2006.01)

(52) U.S. Cl. ..... 345/60; 345/63

(58) Field of Classification Search ..... 345/60–72
See application file for complete search history.

(56) References Cited

U.S. PATENT DOCUMENTS

| | | | | |
|---|---|---|---|---|
| 2003/0189533 | A1* | 10/2003 | Myoung et al. | 345/67 |
| 2005/0248504 | A1* | 11/2005 | Kim et al. | 345/60 |
| 2006/0050024 | A1* | 3/2006 | Kim | 345/67 |
| 2006/0187147 | A1 | 8/2006 | Jeong | |
| 2006/0279479 | A1* | 12/2006 | Jung et al. | 345/60 |
| 2007/0152916 | A1 | 7/2007 | Kim et al. | |

FOREIGN PATENT DOCUMENTS

| | | |
|---|---|---|
| EP | 1 696 409 | 8/2006 |
| EP | 1 806 719 | 7/2007 |
| JP | 2000-242224 | 9/2000 |
| JP | 2006-53564 | 2/2006 |
| JP | 2006-235598 | 9/2006 |

OTHER PUBLICATIONS

International Search Report issued Apr. 3, 2007 in International Application No. PCT/JP2007/053506.
Supplementary European Search Report issued Oct. 30, 2009 in Application No. EP 07 71 4938.

* cited by examiner

*Primary Examiner* — Amare Mengistu
*Assistant Examiner* — Koosha Sharifi-Tafreshi
(74) *Attorney, Agent, or Firm* — Wenderoth, Lind & Ponack, L.L.P.

(57) ABSTRACT

Plural subfields are provided in one single field period, where each subfield has an initialization period during which a gradient waveform voltage gently falling is applied to a scan electrode to generate initializing discharge in a discharge cell; a writing period during which a scan pulse voltage is applied to a scan electrode to generate writing discharge in a discharge cell; and a sustain period during which sustain discharge is generated in a discharge cell selected, by the number of times corresponding to a luminance weight. The lowest voltage of a falling gradient waveform voltage in a subfield with the smallest luminance weight is set so as to be lower than that with the largest luminance weight. A method of driving a plasma display panel is provided that generates stable writing discharge without increasing voltage required for generating writing discharge even for a large-screen, high-luminance panel.

6 Claims, 14 Drawing Sheets

METHOD OF DRIVING PLASMA DISPLAY PANEL AND PLASMA DISPLAY APPARATUS

This Application is a U.S. National Phase Application of PCT International Application PCT/JP2007/053506.

TECHNICAL FIELD

The present invention relates to a method of driving a plasma display panel used for a wall-hung television set and large-size monitor, and to a plasma display apparatus.

BACKGROUND ART

An AC surface-discharge panel, a typical plasma display panel (abbreviated as "panel" hereinafter) has a large number of discharge cells formed between the front and back panels arranged mutually facing. The front panel has plural display electrode pairs, each composed of a pair of scan electrode and sustain electrode, formed parallel to one another on the front glass substrate, and has a dielectric layer and protective layer formed so as to cover the display electrode pairs. The back panel has plural, parallel data electrodes on the back glass substrate, a dielectric layer so as to cover the data electrodes, plural barrier ribs parallel to the data electrodes over the dielectric layer, and a phosphor layer on the top surface of the dielectric layer and on the side surface of the ribs, respectively formed. The front and back panels are arranged mutually facing so that a display electrode pair crosses a data electrode at different levels, and sealed. The internal discharge space is encapsulated with a discharge gas containing xenon by 5% in partial pressure, for example. Here, discharge cells are formed between a display electrode pair and data electrode mutually facing. In a panel with such a structure, ultraviolet light is generated in each discharge cell by means of gas discharge. The ultraviolet light excites phosphors for red (R), green (G) and blue (B) to cause light emission for color display.

One of general methods of driving a panel is subfield method, where a single field period is divided into plural subfields before gradation display is made by means of a combination of subfields made emit light. Each subfield has a initialization period, writing period, and sustain period. In the initialization period, initializing discharge is generated to form wall charge required for the subsequent writing operation on each electrode. In the writing period, writing discharge is generated selectively at a discharge cell to display to form wall charge. Then in the sustain period, sustain pulses are alternately applied to a display electrode pair composed of a scan electrode and a sustain electrode; and sustain discharge is generated at a discharge cell that caused writing discharge to make a corresponding discharge cell emit light for image display.

Another new method of driving a panel among subfield methods is disclosed. That is, initializing discharge is performed using a voltage waveform gently changing, selectively for a discharge cell that performed sustain discharge to reduce light emission not related to gradation display to a minimum level for improving the contrast ratio.

Specifically, in the initialization period of one subfield out of plural subfields, all-cell initializing operation is performed that makes all the discharge cells discharge, and in the initialization period of the other subfields, selective initialization is performed that initializes only discharge cells that have performed sustain discharge. Consequently, light emitting not related to display results in only light emitting accompanying discharge for all-cell initializing operation, enabling image display with a high contrast (refer to patent literature 1, for example).

Thus driving a panel makes the luminance of the black display region changing depending on light emitting not related to image display to be caused only by feeble light emitting in all-cell initializing operation, enabling image display with high contrast.

However, a panel has been increasingly enlarged in screen size as well as providing higher resolution in recent years, making writing discharge unstable. Consequently, writing discharge fails to occur in a discharge cell where display must be performed, thus deteriorating the quality of image display or increasing voltage required for stably generating writing discharge.

[Patent literature 1] Japanese Patent Unexamined Publication No. 2000-242224

SUMMARY OF THE INVENTION

The present invention provides a method of driving a panel and a plasma display apparatus with high quality of image display by generating stable writing discharge without increasing voltage for generating writing discharge even for a large-screen, high-luminance panel.

The present invention is a method of driving a panel equipped with plural discharge cells having display electrode pairs, each composed of a scan electrode and a sustain electrode. The method includes a step of providing in a single field period, plural subfields that has an initialization period during which a gradient waveform voltage gently falling is applied to a scan electrode; a writing period during which writing discharge is generated in a discharge cell by applying a scan pulse voltage to a scan electrode; and a sustain period during which sustain discharge is generated in a discharge cell selected by alternately applying a sustain pulse voltage by the number of times corresponding to a luminance weight to a display electrode pair; and a step of setting the lowest voltage of the falling gradient waveform voltage in a subfield with the smallest luminance weight to be lower than that with the largest luminance weight.

These steps enable generating stable writing discharge without increasing voltage required for generating writing discharge even for a large-screen, high-luminance panel.

In the method of driving a panel of the present invention, the lowest voltage of the falling gradient waveform voltage in a subfield with the largest luminance weight is desirably set to be higher than the scan pulse voltage in the subfield.

In the method of driving a panel of the present invention, it is desirable that at least the lowest voltage of the falling gradient waveform voltage in a subfield with the second smallest luminance weight is set to be lower than that with the largest luminance weight.

In the method of driving a panel of the present invention, it is desirable that a single field period includes an all-cell initializing subfield during which initializing discharge is generated for all the cells to display an image, in the initialization period; and a selectively initializing subfield during which initializing discharge is generated selectively for discharge cells that have generated sustain discharge in the immediately preceding subfield, in the initialization period, where a subfield with the smallest luminance weight is to be the all-cell initializing subfield; and a subfield with the largest luminance weight is to be the selectively initializing subfield.

A plasma display apparatus of the present invention is equipped with a panel including plural discharge cells having display electrode pairs, each composed of a scan electrode and a sustain electrode; and a driving circuit for driving the panel by providing plural subfields in a single field period, each subfield including an initialization period during which a gradient waveform voltage gently falling is applied to a scan electrode, a writing period during which writing discharge is generated in a discharge cell, and a sustain period during which sustain discharge is generated in a discharge cell selected by alternately applying sustain pulse voltages by the number of times corresponding to a luminance weight to a display element pair. The present invention is characterized in that the driving circuit sets the lowest voltage of the falling gradient waveform voltage in a subfield with the smallest luminance weight to be lower than that with the largest luminance weight.

These characteristics enable generating stable writing discharge without increasing voltage required for generating writing discharge even for a large-screen, high-luminance panel.

Figure 1:
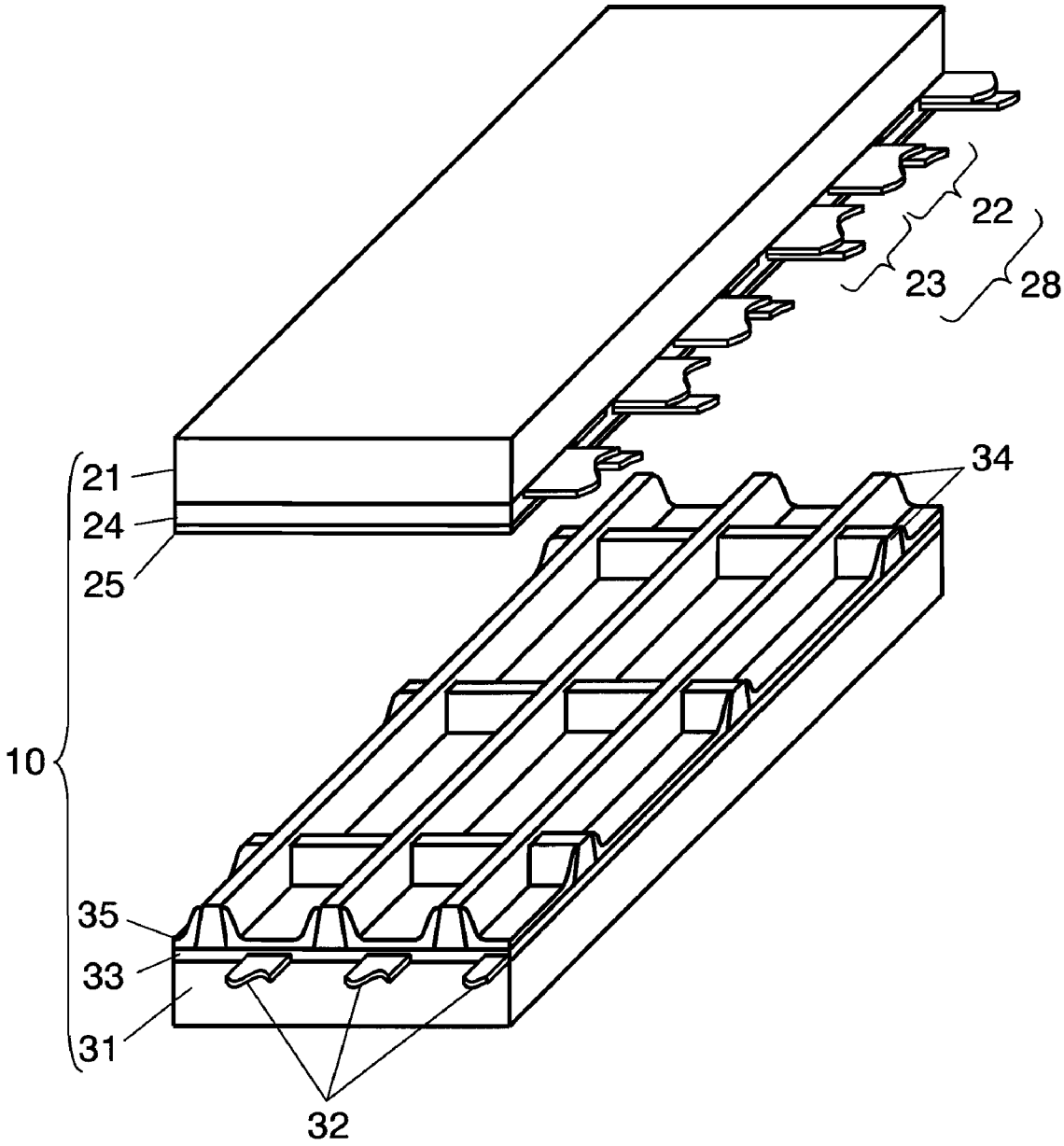
FIG. 1 is an exploded perspective view illustrating the structure of a panel according to the first exemplary embodiment of the present invention.

| Reference marks in the drawings | |
|---|---|
| 1 | Plasma display apparatus |
| 10 | Panel |
| 21 | Glass front panel |
| 22 | Scan electrode |
| 23 | Sustain electrode |
| 24, 33 | Dielectric layer |
| 25 | Protective layer |
| 28 | Display electrode pair |
| 31 | Back panel |
| 32 | Data electrode |
| 34 | Barrier rib |
| 35 | Phosphor layer |
| 51 | Image signal processing circuit |
| 52 | Data electrode driving circuit |
| 53 | Scan electrode driving circuit |
| 54 | Sustain electrode driving circuit |
| 55 | Timing generating circuit |
| 100, 200 | Sustain pulse generating circuit |
| 110 | Power collecting circuit |
| 300 | Initializing waveform generating circuit |
| 310, 320 | Miller integrator |
| 400 | Scan pulse generating circuit |
| SW1, SW2, S31, S32 | Switching element |
| FET1, FET2 | FET |
| C1, C2 | Capacitor |
| R1, R2 | Resistance |
| IN1, IN2 | Input terminal |
| CP | Comparator |
| AG | AND gate |

DETAILED DESCRIPTION OF THE INVENTION

Hereinafter, a description is made for a plasma display apparatus according to the embodiments of the present invention, using the related drawings.

First Exemplary Embodiment

FIG. 1 is an exploded perspective view illustrating the structure of panel 10 according to the first exemplary embodiment of the present invention. Front panel 21, made of glass, has plural display electrode pairs 28 formed thereon, each pair composed of scan electrode 22 and sustain electrode 23. Dielectric layer 24 is formed so as to cover scan electrode 22 and sustain electrode 23, and protective layer 25 is formed on dielectric layer 24. Back panel 31 has plural data electrodes 32 formed thereon, dielectric layer 33 formed so as to cover data electrode 32, and additionally barrier rib 34, double-cross-shaped, formed thereon. The side of barrier rib 34 and the top surface of dielectric layer 33 are provided thereon with phosphor layer 35 that emits red (R), green (G) or blue (B) light.

Front panel 21 and back panel 31 are arranged mutually facing so that display electrode pair 28 crosses data electrode 32, sandwiching a minute discharge space, with the outer circumference sealed with a sealant such as glass frit. The discharge space encapsulates a mixed gas of neon and xenon, for example, as a discharge gas. In the first embodiment, a discharge gas containing xenon by 10% in partial pressure to improve luminance. The discharge space is partitioned into plural partitions by barrier rib 34, and a discharge cell is formed where display electrode pair 28 crosses data electrode 32. These discharge cells discharge and emit light to display an image.

The structure of the panel is not limited to that described above, but it may be provided with stripe barrier ribs, for example.

Figure 2:
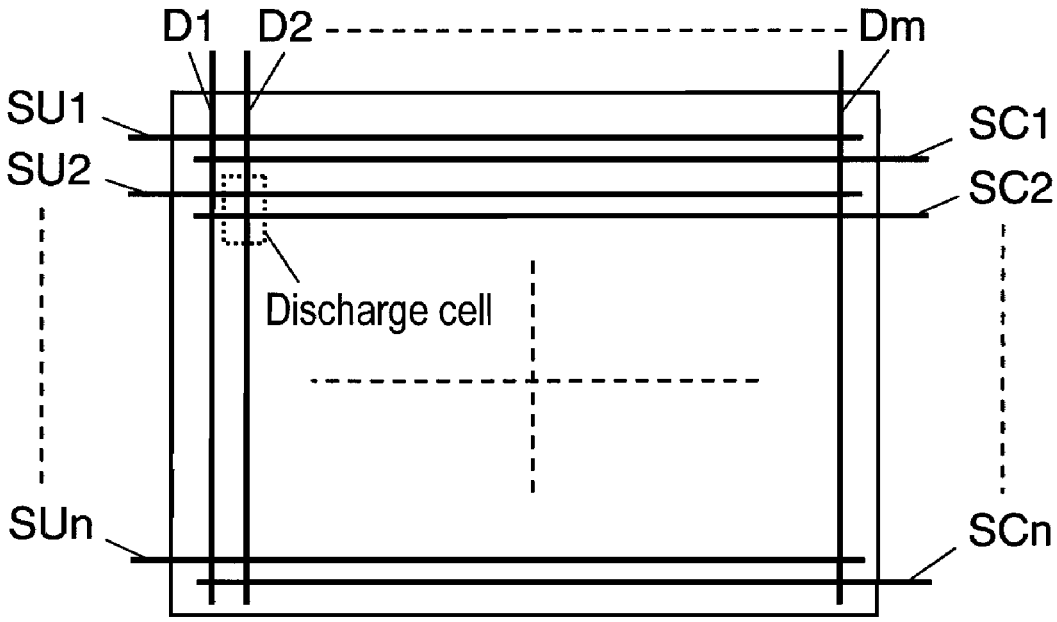
FIG. 2 is an arrangement diagram of electrodes on the panel according to the first embodiment of the present invention.

FIG. 2 is an arrangement diagram of electrodes on panel 10 according to the first embodiment of the present invention. Panel 10 has n pieces of long scan electrodes SC1 through SCn (scan electrode 22 in FIG. 1) and n pieces of sustain electrodes SU1 through SUn (sustain electrode 23 in FIG. 1), arranged in the row direction, and m pieces of long data electrodes D1 through Dm (data electrode 32 in FIG. 1) arranged in the column direction. A discharge cell is formed where a pair of scan electrode SCi (i=1-n) and sustain electrode SUi (i=1-n) crosses one data electrode Dj (j=1-m), a total of m×n pieces of discharge cells in the discharge space. As shown in FIGS. 1, 2, scan electrode SCi and sustain electrode SUi are formed in pairs, parallel to each other, thus providing large inter-electrode capacitance Cp between scan electrodes SC1 through SCn and sustain electrodes SU1 through SUn.

Figure 3:
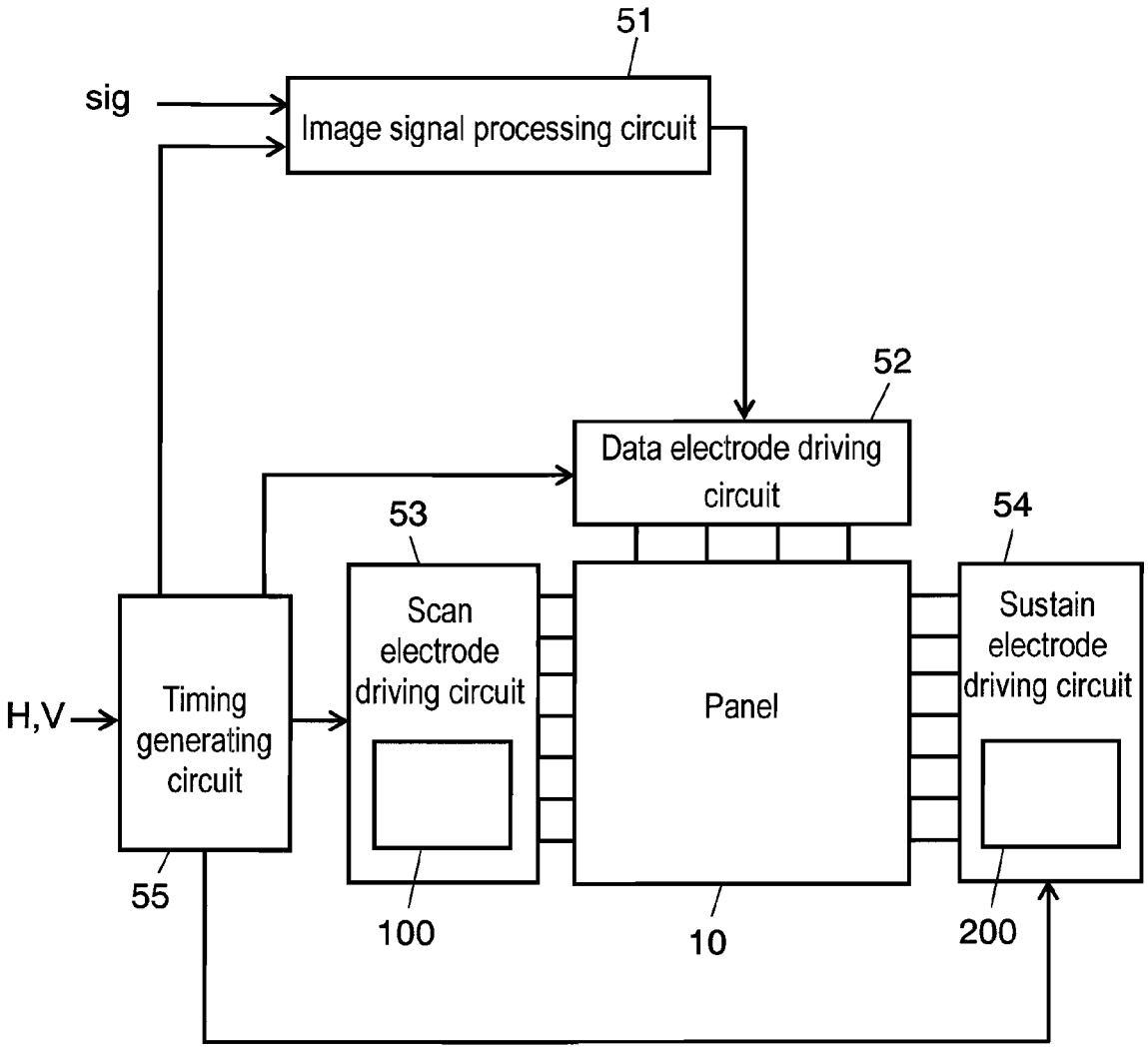
FIG. 3 is a circuit block diagram of a plasma display apparatus according to the first embodiment of the present invention.

FIG. 3 is a circuit block diagram of plasma display apparatus 1 according to the first embodiment of the present invention. Plasma display apparatus 1 is equipped with panel 10, image signal processing circuit 51, data electrode driving circuit 52, scan electrode driving circuit 53, sustain electrode driving circuit 54, timing generating circuit 55, and a power supply circuit (not shown) for supplying power required to each circuit block.

Image signal processing circuit 51 converts image signal sig having been input to image data indicating emitting/non-emitting by subfield. Data electrode driving circuit 52 converts image data by subfield to a signal corresponding to each of data electrodes D1 through Dm to drive each of data electrodes D1 through Dm.

Timing generating circuit 55 generates various types of timing signals for controlling the operation of each circuit block on the basis of horizontal synchronizing signal H and vertical synchronizing signal V to supply each circuit block. Scan electrode driving circuit 53 includes sustain pulse generating circuit 100 for generating sustain pulses for applying to scan electrodes SC1 through SCn in a sustain period, to drive respective scan electrodes SC1 through SCn on the basis of timing signals. Sustain electrode driving circuit 54 includes a circuit for applying voltage Ve1 to sustain electrodes SU1 through SUn in an initialization period, and sustain pulse generating circuit 200 for generating sustain pulses for applying to sustain electrodes SU1 through SUn in a sustain period, to drive sustain electrodes SU1 through SUn on the basis of timing signals.

Next, a description is made for a drive voltage waveform for driving panel 10 and its operation. Plasma display apparatus 1 displays gradation by subfield method, where a single field period is divided into plural subfields, and light-emitting/non-emitting of each discharge cell is controlled by subfield. Each subfield has an initialization period, writing period, and sustain period. In the initialization period, initializing discharge is generated to form wall charge required for the subsequent writing discharge on each electrode. The initializing operation at this moment includes initializing operation (abbreviated as "all-cell initializing operation" hereinafter) in which initializing discharge is generated in all the discharge cells, and initializing operation (abbreviate as "selectively initializing operation" hereinafter) in which initializing discharge is generated in a discharge cell that has performed sustain discharge. In the writing period, writing discharge is generated selectively in a discharge cell to emit light, to form wall charge. In the sustain period, sustain pulses of the number proportional to a luminance weight are alternately applied to a display electrode pair to make sustain discharge generate in a discharge cell where writing discharge has been generated, to emit light. The proportional constant at this moment is called luminance magnification. Details about the structure of a subfield is described later, and a drive voltage waveform in a subfield and its operation are described here.

Figure 4:
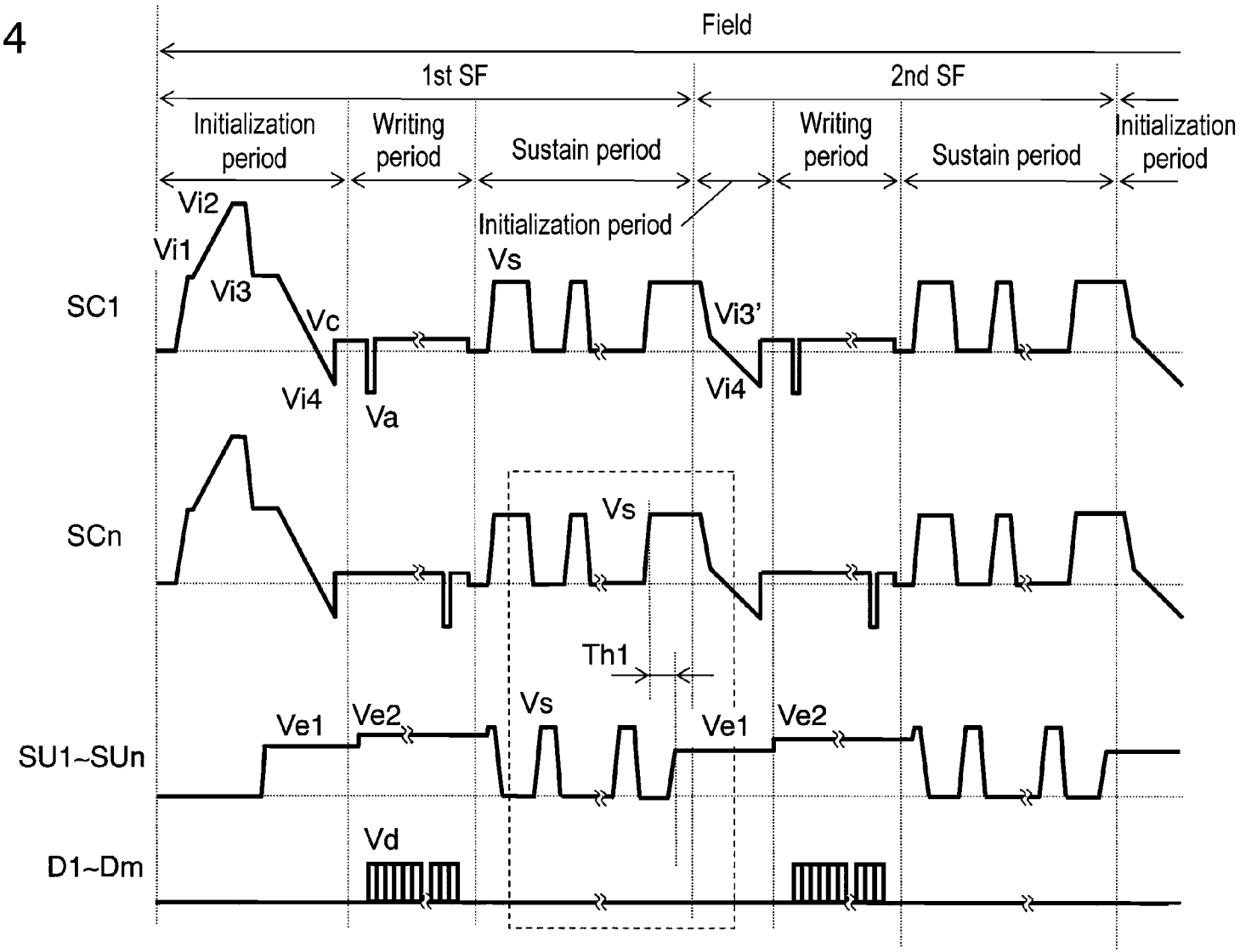
FIG. 4 is a waveform chart of drive voltage applied to each electrode on the panel according to the first embodiment of the present invention.

FIG. 4 is a waveform chart of a drive voltage applied to each electrode on panel 10 according to the first embodiment of the present invention. FIG. 4 shows subfields performing all-cell initializing operation and selectively initializing operation.

First, a description is made for a subfield performing all-cell initializing operation.

In the first half of an initialization period, a voltage of 0 (V) is applied to data electrodes D1 though Dm and sustain electrodes SU1 through SUn, respectively, and a gradient waveform voltage (referred to as "up ramp waveform voltage" hereinafter) gently rising from voltage Vi1, lower than the discharge start voltage for sustain electrodes SU1 through SUn, toward voltage Vi2, higher than the discharge start voltage, is applied to scan electrodes SC1 through SCn. While this gradient waveform voltage is rising, feeble initializing discharge occurs between scan electrodes SC1 through SCn and sustain electrodes SU1 through SUn, and scan electrodes SC1 through SCn and data electrodes D1 though Dm, respectively. Then, negative wall voltage accumulates at the upper parts of scan electrodes SC1 through SCn, and positive wall voltage accumulates at the upper parts of data electrodes D1 though Dm and sustain electrodes SU1 through SUn. Here, wall voltage at the upper parts of electrodes refers to voltage generated by wall charge accumulated on a dielectric layer, protective layer, phosphor layer, and others, covering electrodes.

In the latter half of an initialization period, positive voltage Ve1 is applied to sustain electrodes SU1 through SUn, and a gradient waveform voltage (referred to as "down ramp waveform voltage" hereinafter) gently falling from voltage Vi3, lower than the discharge start voltage for sustain electrodes SU1 through SUn, toward voltage Vi4, higher than the discharge start voltage, is applied to scan electrodes SC1 through SCn (hereinafter, the lowest voltage of the down ramp waveform voltage applied to scan electrodes SC1 through SCn is referred to as "initializing voltage Vi4"). During this time, feeble initializing discharge occurs between scan electrodes SC1 through SCn and sustain electrodes SU1 through SUn, and scan electrodes SC1 through SCn and data electrodes D1 though Dm, respectively. Then, the negative wall voltage at the upper parts of scan electrodes SC1 through SCn and the positive wall voltage at the upper parts of sustain electrodes SU1 through SUn are weakened, and the positive wall voltage at the upper parts of data electrodes D1 though Dm is adjusted to a value suitable for writing operation. This completes all-cell initializing operation in which initializing discharge is performed for all the discharge cells.

Here, initializing discharge generated by applying a down ramp waveform voltage to scan electrodes SC1 through SCn weakens the wall voltage at the upper parts of data electrodes D1 though Dm. Consequently, the wall voltage at the upper parts of data electrodes D1 though Dm changes according to the lowest initializing voltage Vi4 of the down ramp waveform voltage. Increasing initializing voltage Vi4 reduces effects to weaken wall voltage, to increase the wall voltage at the upper parts of data electrodes D1 though Dm; decreasing initializing voltage Vi4 enhances effects to weaken wall voltage, to decrease the wall voltage at the upper parts of data electrodes D1 though Dm. In the first embodiment, this initializing voltage Vi4 is switched with two different voltages corresponding to a luminance weight. Hereinafter, the higher voltage is described as Vi4H; the lower, Vi4L. Further details about the operation is described later.

In the subsequent writing period, voltage Ve2 is applied to sustain electrodes SU1 through SUn; voltage Vc, to scan electrodes SC1 through SCn.

Next, while applying negative scan pulse voltage Va to scan electrode SC1 at the first row, positive writing pulse voltage Vd is applied to data electrode Dk (k=1-m) of a discharge cell to be made emit light at the first row, from among data electrodes D1 though Dm. At this moment, the voltage difference between the intersections on data electrode Dk and on scan electrode SC1 results in the difference (Vd−Va) of externally applied voltages with the difference between the wall voltages on data electrode Dk and on scan electrode SC1 added, which exceeds the discharge start voltage. Then, writing discharge occurs between data electrode Dk and scan electrode SC1, and between sustain electrode SU1 and scan electrode SC1; positive wall voltage accumulates on scan electrode SC1; negative wall voltage accumulates on sustain electrode SU1 as well as on data electrode Dk.

In this way, writing operation is performed in which writing discharge is generated in a discharge cell to be made emit light at the first row to accumulate wall voltage on each electrode. Meanwhile, the voltage at intersections of data electrodes D1 though Dm to which writing pulse voltage Vd has not been applied, scan electrode SC1 does not exceed the discharge start voltage, and thus writing discharge does not occur. The above-described writing operation is performed in all the way to the discharge cell at the n-th row of scan electrode SCn, to complete the writing period.

In the subsequent sustain period, the panel is driven using a power collecting circuit in order to reduce the power consumption. First, while applying positive sustain pulse voltage Vs to scan electrodes SC1 through SCn, a voltage of 0 (V) is applied to sustain electrodes SU1 through SUn. Then, in a discharge cell that generated writing discharge in the last writing period, the voltage difference between the voltages on scan electrode SCi and on sustain electrode SUi results in a voltage gained by adding the difference between the wall voltages on scan electrode SCi and on sustain electrode SUi, to sustain pulse voltage Vs, which exceeds the discharge start voltage. Then, sustain discharge occurs between scan electrode SCi and sustain electrode SUi, and ultraviolet light generated at this moment causes phosphor layer 35 to emit light. Then, negative wall voltage accumulates on scan electrode SCi; positive wall voltage accumulates on sustain electrode SUi and on data electrode Dk as well. In a discharge cell that did not generate writing discharge in the writing period, sustain discharge does not occur, maintaining the wall voltage when the initialization period ends.

Subsequently, a voltage of 0 (V) is applied to scan electrodes SC1 through SCn; sustain pulse voltage Vs, to sustain electrodes SU1 through SUn. Then in a discharge cell that generated sustain discharge, the voltage difference between the voltages on sustain electrode SUi and on scan electrode SCi exceeds the discharge start voltage, and thus sustain discharge occurs again between sustain electrode SUi and scan electrode SCi, negative wall voltage accumulates on sustain electrode SUi; positive wall voltage accumulates on scan electrode SCi. In the same way since then, sustain pulses of the number of the luminance weight multiplied by the luminance magnification are applied alternately to scan electrodes SC1 through SCn and sustain electrodes SU1 through SUn, to provide potential difference between the electrodes of a display electrode pair, continuing sustain discharge in a discharge cell that generated writing discharge in the writing period.

Then, at the end of the sustain period, a narrow-width, pulsatile voltage difference is applied between scan electrodes SC1 through SCn and sustain electrodes SU1 through SUn, and the wall voltage on scan electrode SCi and on sustain electrode SUi is partially or totally removed while leaving the positive wall voltage on data electrode Dk. Specifically, after temporarily returning sustain electrodes SU1 through SUn to 0 (V), sustain pulse voltage Vs is applied to scan electrodes SC1 through SCn. Then, sustain discharge occurs between sustain electrode SUi and scan electrode SCi of a discharge cell that generated sustain discharge. Then, before this discharge converges, namely while charged particles generated by discharge remain sufficiently in the discharge space, voltage Ve1 is applied to sustain electrodes SU1 through SUn. This operation causes the voltage difference between sustain electrode SUi and scan electrode SCi to be weakened to approximately (Vs−Ve1). Then, the wall voltage between on scan electrodes SC1 through SCn and on sustain electrodes SU1 through SUn is weakened to approximately the voltage difference (Vs−Ve1) applied to each electrode while leaving the positive wall charge on data electrode Dk.

In this way, at the last sustain discharge, namely in a given time interval (referred to as "erasing phase difference Th1" hereinafter) after voltage Vs for generating erasing discharge is applied to scan electrodes SC1 through SCn, voltage Ve1 for absorbing the potential difference between the electrodes of a display electrode pair is applied to sustain electrodes SU1 through SUn. These operation completes sustain operation in a sustain period.

Next, a description is made for the operation of a subfield in which selectively initializing operation is performed.

In an initialization period for selectively initializing operation, voltage Ve1 is applied to sustain electrodes SU1 through SUn; 0 (V), to data electrodes D1 though Dm. A down ramp waveform voltage gently falling from voltage Vi3' toward voltage Vi4 is applied to scan electrodes SC1 through SCn. Then, in a discharge cell that generated sustain discharge in the sustain period of the last subfield, feeble initializing discharge occurs to weaken the wall voltage on scan electrode SCi and on sustain electrode SUi. On data electrode Dk, the sufficient positive wall voltage accumulates, and thus excessive portion of the wall voltage is discharged to be adjusted to that suitable for writing operation. Meanwhile, in a discharge cell that did not generate sustain discharge in the last subfield, discharge does not occur, but the wall charge when the initialization period of the last subfield ended remains unchanged. Selectively initializing operation thus performs initializing discharge selectively for a discharge cell that performed sustain operation in the sustain period of the immediately preceding subfield.

Here, initializing discharge generated by applying a down ramp waveform voltage to scan electrodes SC1 through SCn weakens the wall voltage at the upper parts of data electrodes D1 though Dm, as well. Consequently, the wall voltage at the upper parts of data electrodes D1 though Dm changes according to the lowest initializing voltage Vi4 of the down ramp waveform voltage. Increasing initializing voltage Vi4 reduces effects to weaken wall voltage, to increase the wall voltage at the upper parts of data electrodes D1 though Dm; decreasing initializing voltage Vi4 enhances effects to weaken wall voltage, to decrease the wall voltage at the upper parts of data electrodes D1 though Dm. In the first embodiment, this initializing voltage Vi4 is switched with two different voltages, namely Vi4H, the higher voltage, and Vi4L, the lower, corresponding to a luminance weight.

The operation in the subsequent writing period is the same as that in a subfield in which all-cell initializing operation is performed, and thus its description is omitted. The operation in the subsequent sustain period is the same except for the number of sustain pulses.

Figure 5:
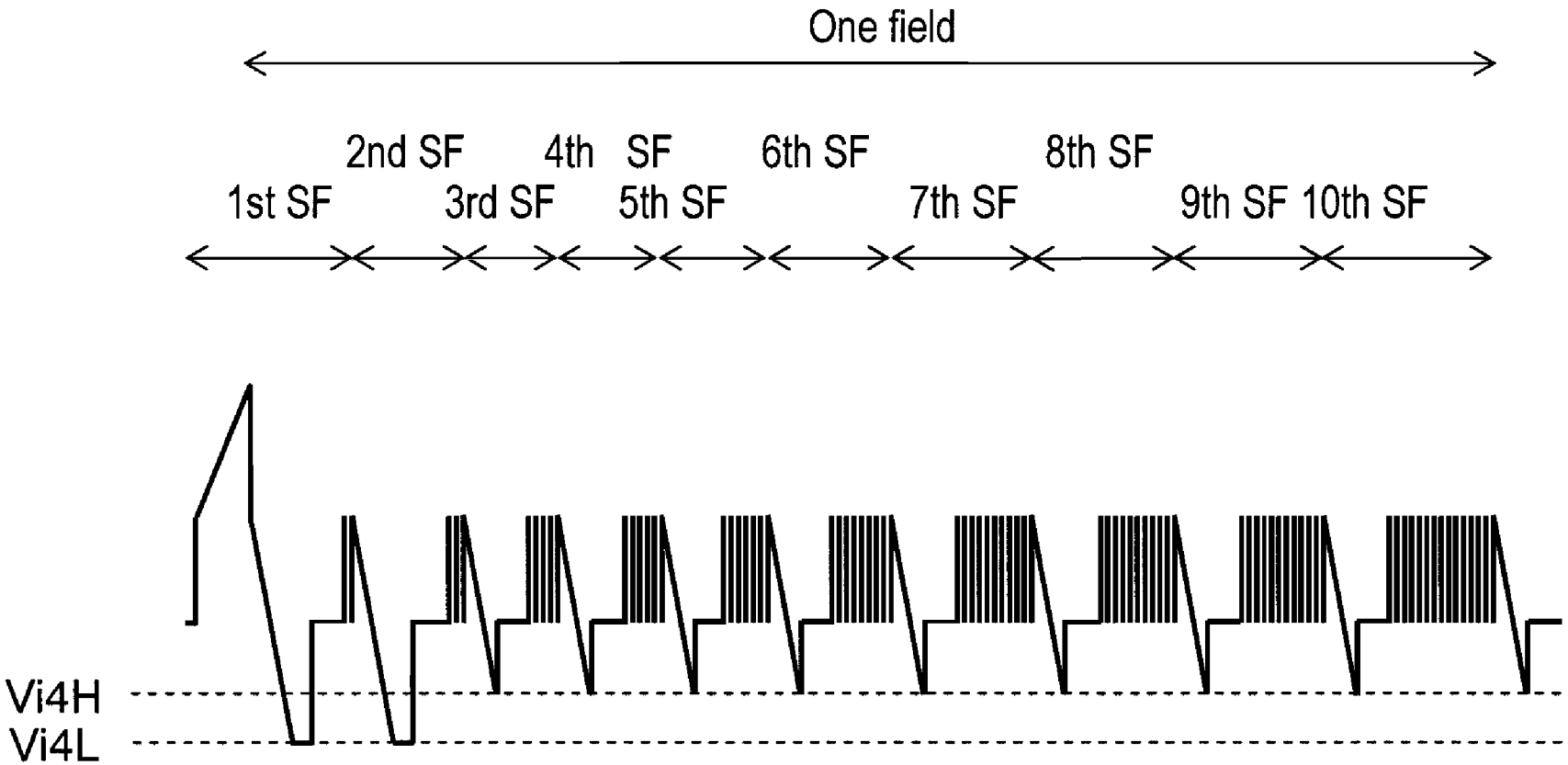
FIG. 5 illustrates the structure of a subfield according to the first embodiment of the present invention.

Next, a description is made for the structure of a subfield. FIG. 5 illustrates the structure of a subfield in the first embodiment of the present invention. FIG. 5 illustrates a simplified driving waveform during one field in subfield method, where the driving waveform of each subfield is the same as that in FIG. 4.

In the first embodiment, one field is divided into 10 subfields (1st SF, 2nd SF, . . . , 10th SF), and the subfields have luminance weights of (1, 2, 3, 6, 11, 18, 30, 44, 60, 80), for example.

In a sustain period of each subfield, sustain pulses of the number of the luminance weight of each subfield multiplied by a given luminance magnification are applied to each display electrode pair.

In the first embodiment, all-cell initializing operation is assumed to be performed in the initialization period of 1st SF; selectively initializing operation, in initialization period of 2nd SF through 10th SF.

However, the present invention does not limit the number of subfields or the luminance weight of each subfield to the above-described values. Further, the structure of a subfield may be switched on the basis of an image signal or the like.

In the first embodiment, the lowest voltage of the down ramp waveform voltage in a subfield with the smallest luminance weight is set to be lower than that with the largest luminance weight, implementing stable writing discharge.

Specifically, as shown in FIG. 5, initializing voltage Vi4 of the down ramp waveform voltage in 1st SF with the smallest luminance weight and in 2nd SF with the next smallest luminance weight, is Vi4L; and that in 3rd SF through 10th SF, is Vi4H, higher than Vi4L. The following describe the reason.

Hereinafter, a description is made about writing discharge, which is triggered by discharge between data electrode 32 and scan electrode 22. Therefore, the description here is made mainly for discharge between data electrode 32 and scan electrode 22.

Figure 6:
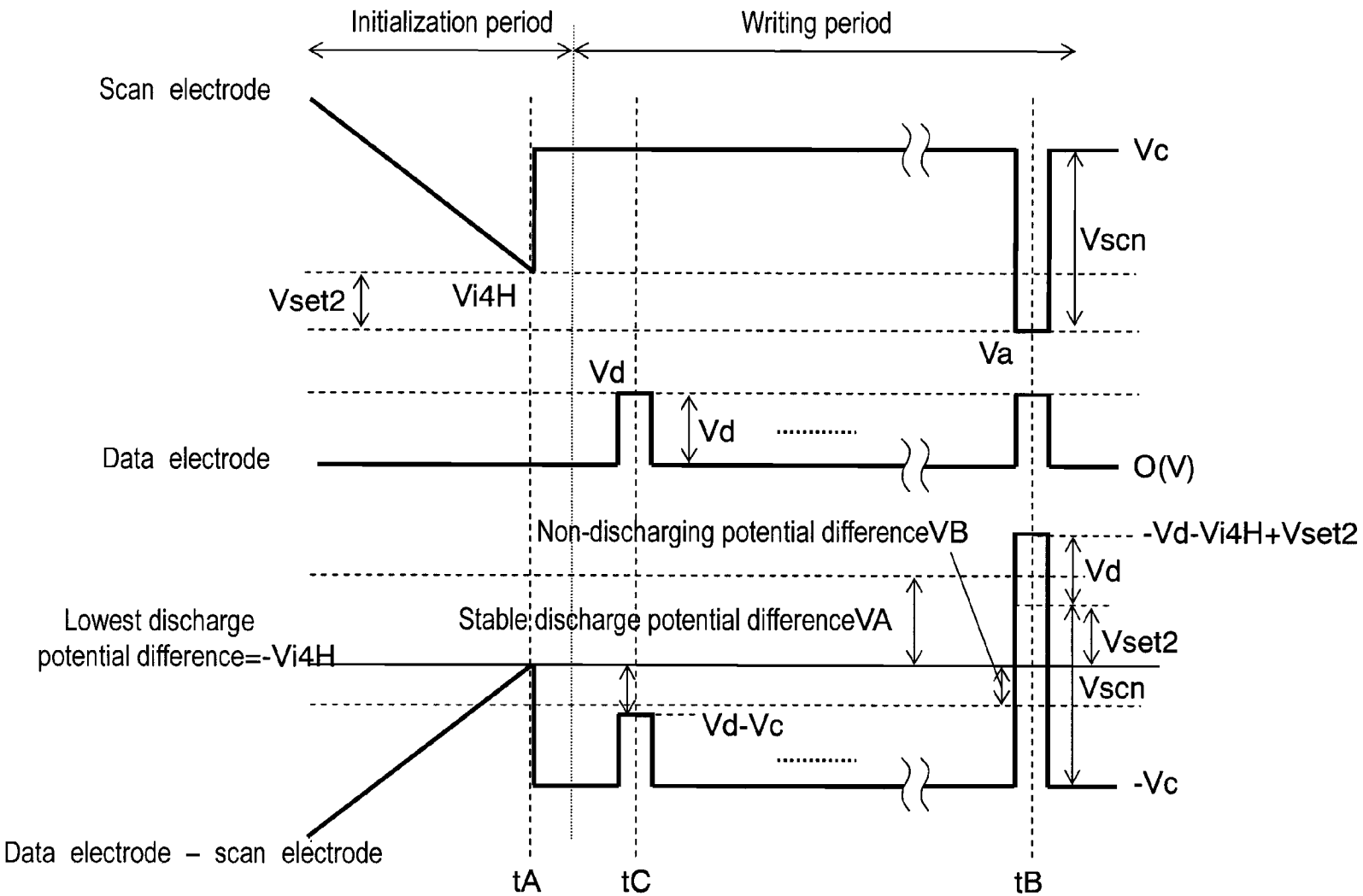
FIG. 6 illustrates a drive voltage waveform applied to a data electrode and scan electrode, and the change of voltage between the data electrode and scan electrode, according to the first embodiment of the present invention.

FIG. 6 illustrates a drive voltage waveform applied to data electrode 32 and scan electrode 22, and the potential difference between data electrode 32 and scan electrode 22 (i.e. (drive voltage waveform applied to data electrode)−(drive voltage waveform applied to scan electrode)), in the first embodiment of the present invention. Here, assumption is made that initializing voltage Vi4 is voltage Vi4H; (Vc−Va), which is the amplitude of negative scan pulse voltage Va, is a voltage higher than voltage (Vc−Vi4H), which is negative voltage Vi4H viewed from positive voltage Vc, by voltage Vset2, namely $$(Vc-Va)=(Vc-Vi4H)+Vset2$$

that is, $$Va=Vi4H-Vset2$$

Hereinafter, amplitude (Vc−Va) of the scan pulse voltage is abbreviated as Vscn.

At clock time tA, immediately after initializing discharge ends, the voltage applied to data electrode 32 is 0 (V); to scan electrode 22, Vi4H. The potential difference between data electrode 32 and scan electrode 22 is thus equal to (−Vi4H). Then, the voltage gained by adding the wall voltage to this potential difference equals to approximately the discharge start voltage. This is definite from the fact that weak initializing discharge has been generated between data electrode 32 and scan electrode 22 until clock time tA in the initialization period. Therefore, potential difference (−Vi4H) between data electrode 32 and scan electrode 22 is borderline (this potential difference is described as "lowest discharge voltage" hereinafter) to starting discharge.

Meanwhile, at clock time tB, when starting to generate writing discharge, negative scan pulse voltage Va is being applied to scan electrode 22; writing pulse voltage Vd, to data electrode 32, and thus the potential difference of (Vd−Va), namely (Vd−Vi4H+Vset2), is being applied between data electrode 32 and scan electrode 22. The potential difference is higher than lowest discharge voltage (−Vi4H) by (Vd+Vset2), thus generating writing discharge in a discharge cell.

However, in order for the writing discharge to be stable, the potential difference between data electrode 32 and scan electrode 22 must exceed a voltage higher than lowest discharge voltage (−Vi4H) by a given potential difference (described as "stable discharge voltage" hereinafter) VA. That is, $$Vd-Vi4H+Vset2>-Vi4H+VA$$

that is to say, writing pulse voltage Vd must be $$Vd>VA-Vset2 \quad \text{(expression 1)}$$

In a state where negative scan pulse voltage Va is not being applied to scan electrode 22, at clock time tC for example, voltage Vc is being applied to scan electrode 22; writing pulse voltage Vd, to data electrode 32, and thus the potential difference between data electrode 32 and scan electrode 22 is (Vd−Vc). At this moment, the potential difference between data electrode 32 and scan electrode 22 must be lower than lowest discharge voltage (−Vi4H) so that undesired discharge will not occur. That is, $$Vd-Vc<-Vi4H$$

However, if the discharge cell is at a borderline voltage to starting discharge, the wall charge may decrease because of priming and the like, causing an apparent dark current to flow to reduce the wall voltage. Particularly, a high ratio (described as "light-emission rate" hereinafter) of the number of discharge cells to be made emit light to all the discharge cells prolongs time during which writing pulse voltage Vd is applied to data electrode 32, and so does time during which a dark current flows. Therefore, in order to suppress a decrease of the wall charge, a dark current itself needs to be reduced. For this reason, even if writing pulse voltage Vd is applied to data electrode 32, the potential difference between data electrode 32 and scan electrode 22 must be a voltage further lower than the lowest discharge voltage (−Vi4H) by a given voltage (described as "non-discharging voltage" hereinafter) VB. That is, $$Vd-Vc<-Vi4H-VB$$

thus, $$Vd-Vc<-(Va+Vset2)-VB$$

that is, $$Vscn>Vset2+VB+Vd \quad \text{(expression 2)}$$

must be held. That is to say, the following two conditions must be satisfied.

$$Vd>VA-Vset2 \quad \text{(expression 1)}$$

$$Vscn>Vd+Vset2+VB \quad \text{(expression 2)}$$

Consequently, setting Vset2 to a certain large value is advantageous to reduce amplitude Vd of the writing pulse voltage. However, the value must be in a degree that does not generate writing discharge if scan pulse voltage Va is applied to scan electrode 22, and writing pulse voltage Vd is not applied to data electrode 32.

The above describes a writing period of one subfield. The next describes a case where plural subfields have different possibilities of discharge.

Here, an example is given where two subfields, 1st SF and 2nd SF, are provided to simplify the description.

Figure 7:
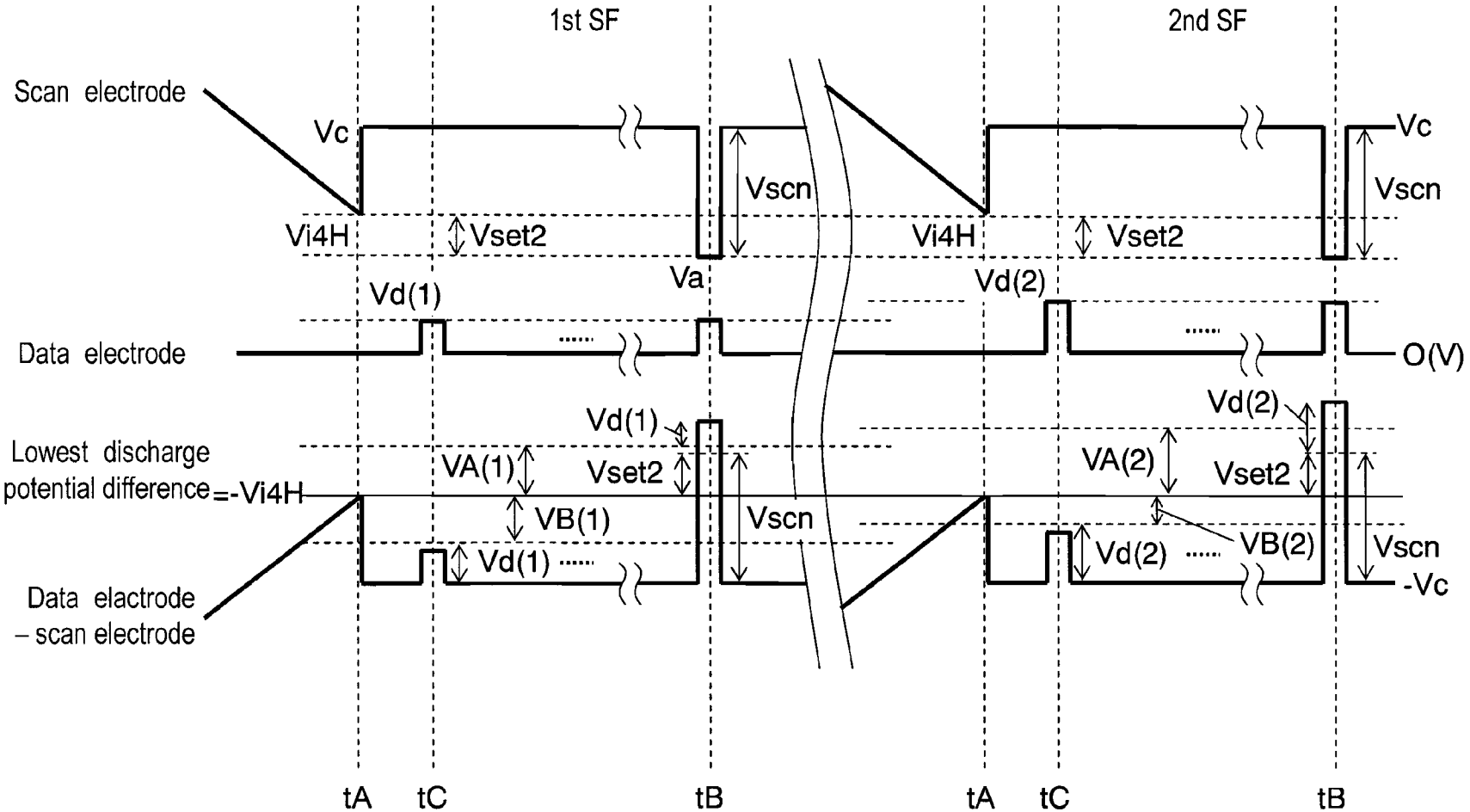
FIG. 7 illustrates an example of a drive voltage waveform applied to a data electrode and scan electrode, and the change of voltage between the data electrode and scan electrode, according to the first embodiment of the present invention.

FIG. 7 illustrates an example of a drive voltage waveform applied to data electrode 32 and scan electrode 22, and the potential difference between data electrode 32 and scan electrode 22, in a case where 1st SF is more likely to discharge than 2nd SF, in the first embodiment of the present invention.

In this case, one of the above-described conditions must be satisfied for each subfield. That is, for 1st SF, $$Vd(1)>VA(1)-Vset2(1) \quad \text{(expression 3)}$$

$$Vscn(1)>Vd(1)+Vset2(1)+VB(1) \quad \text{(expression 4)}$$

for 2nd SF, $$Vd(2)>VA(2)-Vset2(2) \quad \text{(expression 5)}$$

$$Vscn(2)>Vd(2)+Vset2(2)+VB(2) \quad \text{(expression 6)}$$

As shown in FIG. 7, 1st SF is more likely to discharge than 2nd SF, which means that stable discharge voltage VA(1) required for generating stable writing discharge in 1st SF is lower than stable discharge voltage VA(2) in 2nd SF, and non-discharging voltage VB(1) in 1st SF is higher than non-discharging voltage VB(2) in 2nd SF. In this way, the following expressions hold.

$$VA(1)<VA(2),\ VB(1)>VB(2)$$

Thus, writing pulse voltage Vd(i) in 1st SF can be set lower than writing pulse voltage Vd(2) in 2nd SF. However, the circuitry makes it difficult to change the writing pulse voltage Vd by subfield. Doing so requires impractical, complicated circuitry, which means that writing pulse voltage Vd(2), the higher one, is selected as writing pulse voltage Vd.

Then, Vd(2) is substituted for Vd(1) in (expression 4), possibly causing (expression 4) not to be satisfied. Under the circumstances, in order to satisfy (expression 4) in such a case, voltage Vc may be set to Vc(1), which is higher than Vc by (Vd(2)−Vd(1)).

Figure 8:
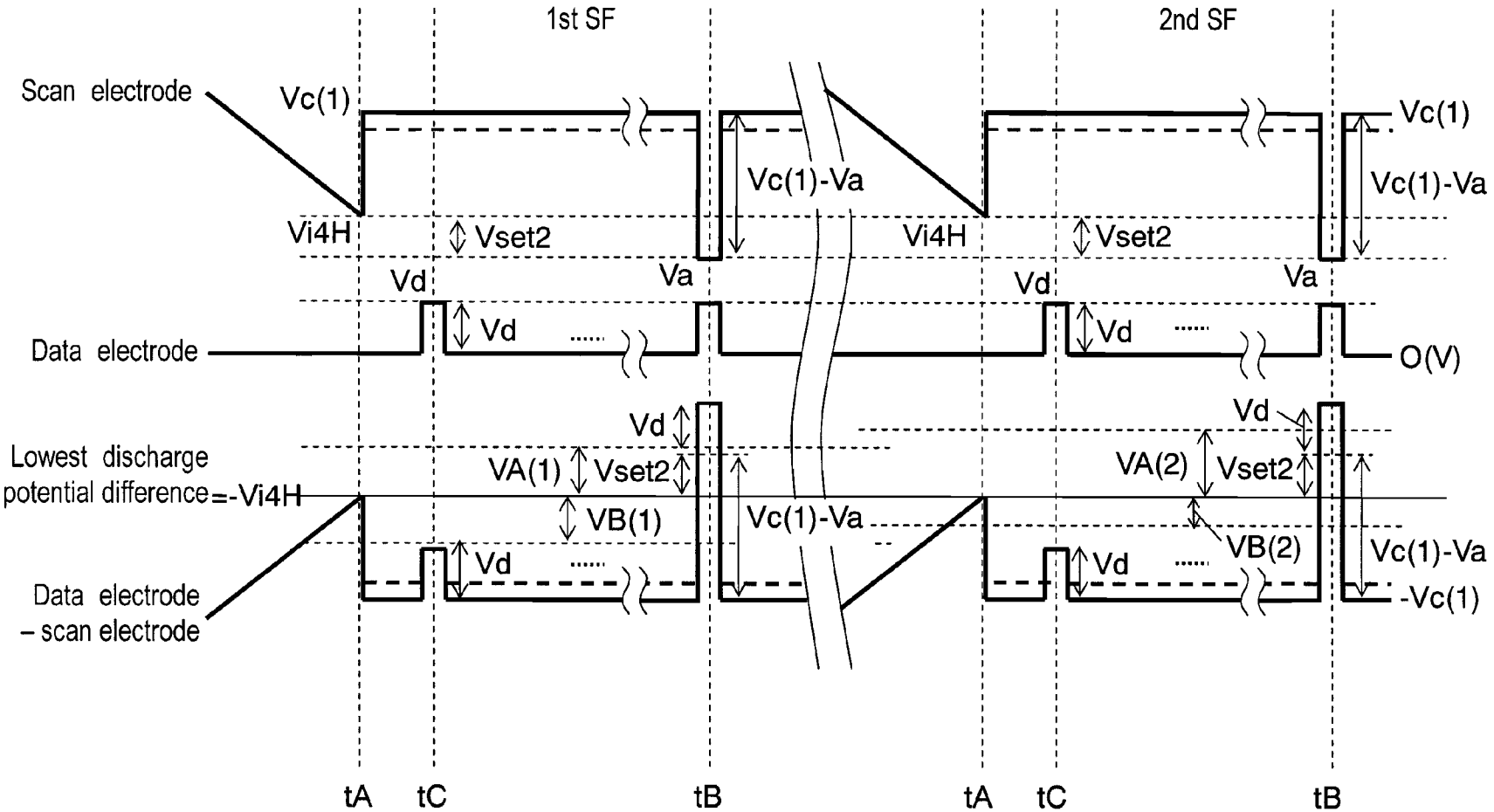
FIG. 8 illustrates another example of a drive voltage waveform applied to a data electrode and scan electrode, and the change of voltage between the data electrode and scan electrode, according to the first embodiment of the present invention.

FIG. 8 illustrates an example of a drive voltage waveform applied to data electrode 32 and scan electrode 22, and change of the voltage between data electrode 32 and scan electrode 22, in a case where 1st SF is more likely to discharge than 2nd SF, in the first embodiment of the present invention. In this case, amplitude Vscn of the scan pulse voltage increases to (Vc(1)−Va), thus requiring the drive power to be increased, and possibly increasing the cost such as for improving the withstand voltage of components used for the driving circuit.

Under the circumstances, Vset2(1) in 1st SF is set to be low so that initializing voltage Vi4 will be voltage Vi4L. Then, writing pulse voltage Vd can be set to be low without changing potential Vc of scan electrode 22.

Figure 9:
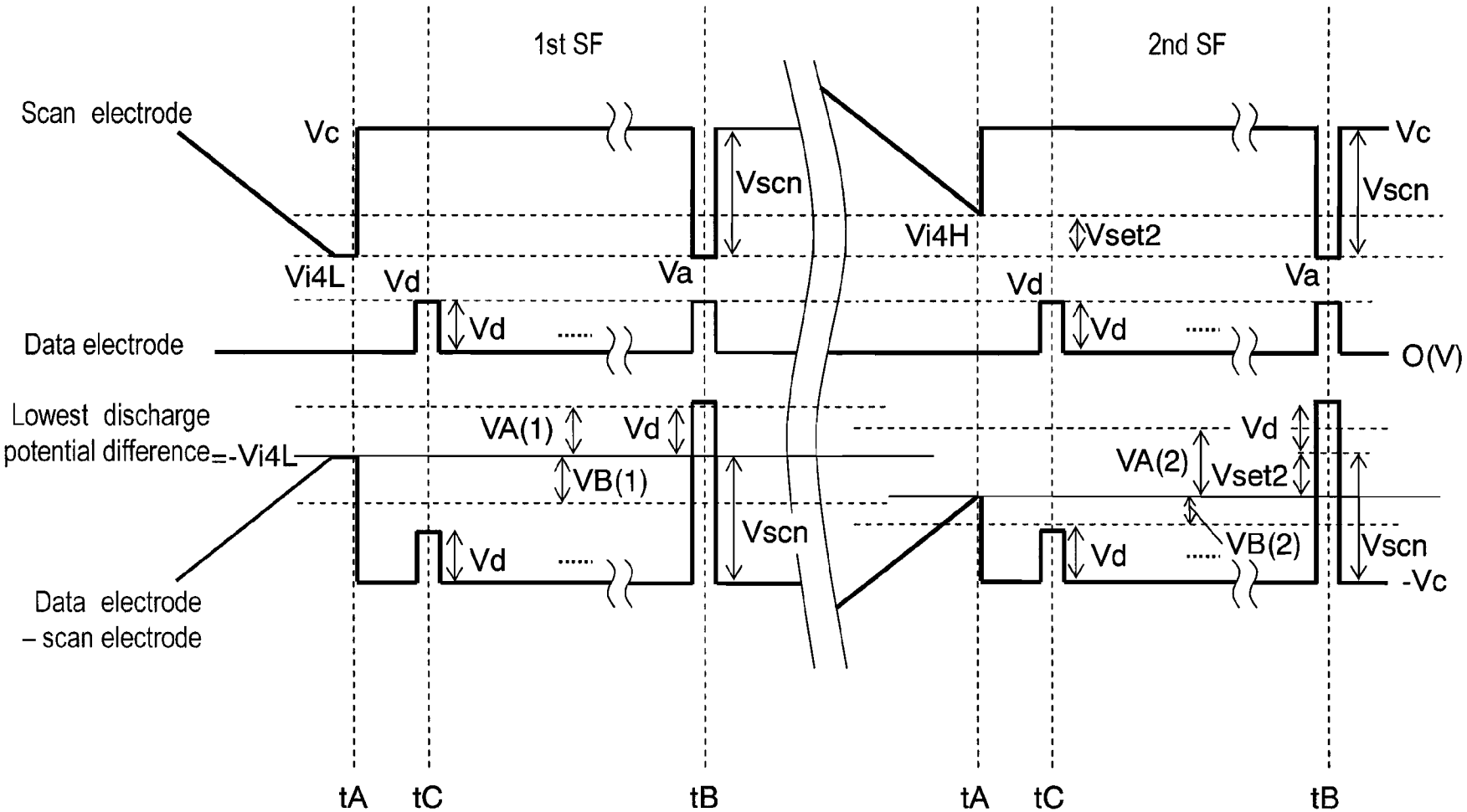
FIG. 9 illustrates yet another example of a drive voltage waveform applied to a data electrode and scan electrode, and the change of voltage between the data electrode and scan electrode, according to the first embodiment of the present invention.

FIG. 9 illustrates still another example of a drive voltage waveform applied to data electrode 32 and scan electrode 22, and change of the voltage between data electrode 32 and scan electrode 22, in a case where 1st SF is more likely to discharge than 2nd SF, in the first embodiment of the present invention. Here, the following expressions hold.

$$VA(1)<VA(2)$$

$$Vset2(1)<Vset2(2)$$

Under the circumstances, if Vset2(1) is set so as to satisfy the next expression:

$$VA(2)-VA(1)=Vset2(2)-Vset2(1) \quad \text{(expression 7)},$$

from $$Vd(1)>VA(1)-Vset2(1) \quad \text{(expression 3)}$$

$$Vd(2)>VA(2)-Vset2(2) \quad \text{(expression 5)},$$

the equation Vd(1)=Vd(2) can be held.

Here, the following expressions hold.

$$VB(1)>VB(2)$$

$$Vset2(1)<Vset2(2)$$

Under the circumstances, if Vset2(1) is set so as to satisfy the next expression:

$$VB(1)-VB(2)=Vset2(2)-Vset2(1) \quad \text{(expression 8)},$$

from $$Vscn(1)>Vd(1)+Vset2(1)+VB(1) \quad \text{(expression 4)}$$

$$Vscn(2)>Vd(2)+Vset2(2)+VB(2) \quad \text{(expression 6)},$$

the equation Vscn(1)=Vscn(2) can be held, and as shown in FIG. 9, both amplitude Vd of the writing pulse voltage and amplitude Vscn of the scan pulse voltage can be reduced.

Clearly, although (expression 7) and (expression 8) do not necessarily hold simultaneously, the voltage between data electrode 32 and scan electrode 22 exceeds stable discharge voltages VA(1), VA(2) at clock time tB both in 1st SF and 2nd SF, generating stable writing discharge. At clock time tC, the voltage between data electrode 32 and scan electrode 22 falls below non-discharging voltages VB(1), VB(2), not generating undesired discharge.

Alternatively, in a case where the voltage setting of writing pulse voltage Vd and scan pulse voltage Va are not changed, the drive margin increases, thus making writing discharge further stable.

That is, difference in possibility of discharge by subfield requires writing pulse voltage Vd and amplitude Vscn of the scan pulse voltage to be set to those of a subfield with their highest values, and thus they need to be set to be high accordingly. However, adjusting voltage Vset2 according to the possibility of discharge as described above to uniform the possibility of discharge in each subfield allows writing pulse voltage Vd and amplitude Vscn of the scan pulse voltage actually applied to be set to a minimum, respectively.

In the first embodiment, 1st SF is an all-cell initializing subfield and sufficient priming is supplied in the writing period of 1st SF, and thus 1st SF is assumed to be a subfield where discharge is most likely to occur. For the above-described reason, setting Vset2 to be low in such a subfield is assumed to allow writing pulse voltage Vd and scan pulse voltage Va to be set to be low.

Under the circumstances, in the first embodiment, Vset2 is switched according to the luminance weight of a subfield to switch initializing voltage Vi4 at Vi4L and Vi4H, higher than Vi4L, implementing stable writing. More specifically, in a subfield (1st SF, 2nd SF in the first embodiment) with a small luminance weight, Vset2 is set to 0 (V) as shown in FIG. 9, to decrease initializing voltage Vi4 to make the down ramp waveform voltage into a deep waveform, prolonging the discharge period for initializing discharge. This operation enhances effects to weaken wall voltage, to decrease the wall voltage at the upper parts of data electrodes D1 though Dm, and reduces the possibility that the wall charge of a discharge cell in a row not selected is lowered so that stable writing operation will be performed. In a subfield (3rd SF to 10th SF in the first embodiment) with a large luminance weight, Vset2 is set to a given voltage (10 (V) in the first embodiment) to increase initializing voltage Vi4 to make the down ramp waveform voltage into a shallow waveform, shortening the discharge period for initializing discharge. This operation increases the amount of residual wall charge on the upper parts of data electrodes D1 though Dm to raise the wall voltage, increasing the relative value of writing pulse voltage Vd to the discharge start voltage to generate stable writing discharge.

Next, a description is made for the reason why subfields with Vi4L as initializing voltage Vi4 are 1st SF and 2nd SF, and those with Vi4H as initializing voltage Vi4 are 3rd SF through 10th SF, in the first embodiment.

The inventor conducted experiments to examine scan pulse voltage Va and writing pulse voltage Vd required for stable writing, while changing a subfield where initializing voltage Vi4 is switched, in order to learn at which subfield Vset2 is to be set to a low value, in other words, how subfields are to be structured to optimally switch initializing voltage Vi4. In the experiment, one field is divided into 10 subfields (1st SF through 10th SF), and the subfields are given luminance weights of (1, 2, 3, 6, 11, 18, 30, 44, 60, 80). Vset2 is set to 0 (V) to make Vi4L equal to scan pulse voltage Va, and Vset2 is set to a given voltage (10 (V) in the first embodiment) to make Vi4H 10 (V) higher than Vi4L.

Figure 10A:
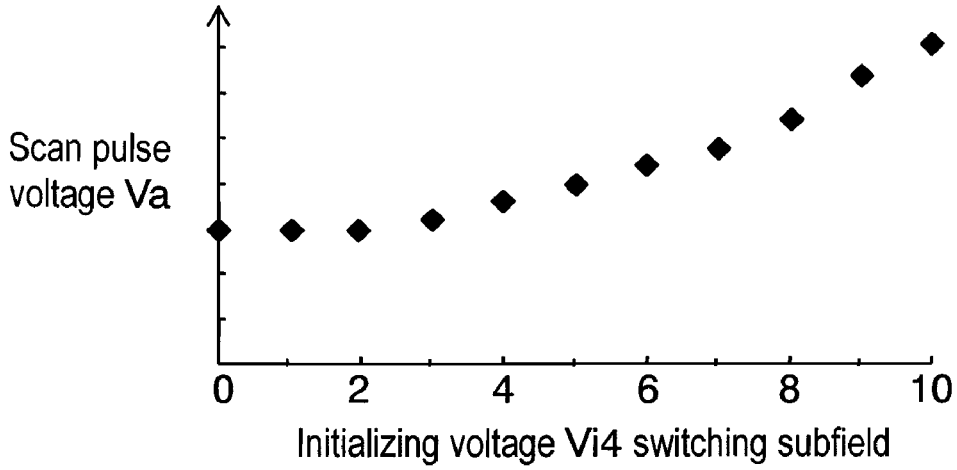
FIG. 10A illustrates relationship between a subfield where initializing voltage Vi4 is switched, and scan pulse voltage, according to the first embodiment of the present invention.
Figure 10B:
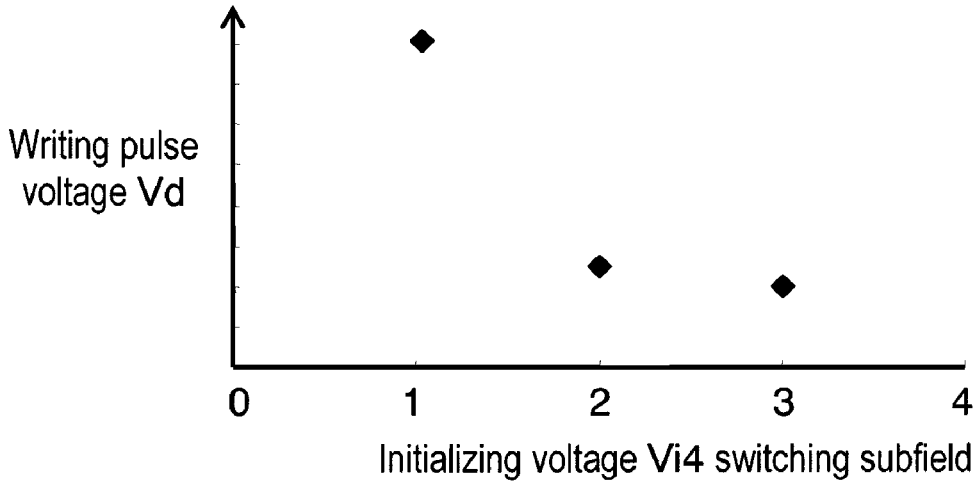
FIG. 10B illustrates relationship between a subfield where initializing voltage Vi4 is switched, and writing pulse voltage, according to the first embodiment of the present invention.

FIGS. 10A, 10B summarize the experiment result, illustrating relationship of a subfield where initializing voltage Vi4 is switched, with scan pulse voltage Va and writing pulse voltage Vd. In FIGS. 10A, 10B, the horizontal axis shows a subfield for switching initializing voltage Vi4; the vertical axis in FIG. 10A, scan pulse voltage Va; and the vertical axis in FIG. 10B, writing pulse voltage Vd. Here, a subfield for switching initializing voltage Vi4 shows a subfield where initializing voltage Vi4 is switched from Vi4L to Vi4H. For example, "2" of a subfield for switching initializing voltage Vi4 indicates that initializing voltage Vi4 is set to Vi4L in 1st SF and 2nd SF, and to Vi4H in 3rd SF through 10th SF.

As shown in FIG. 10A, in a subfield for switching initializing voltage Vi4 with "0" (initializing voltage Vi4 is to be Vi4H for all the subfields), "1", or "2", scan pulse voltage Va required for stable writing hardly changes. Since then, however, as the initializing voltage Vi4 switching subfield is enlarged, scan pulse voltage Va required for stable writing is gradually increasing. In initializing voltage Vi4 switching subfield with "10" (initializing voltage Vi4 is to be Vi4L in all the subfields), scan pulse voltage Va required for stable writing is approximately 20 (V) higher compared with initializing voltage Vi4 switching subfield with "2".

As shown in FIG. 10B, when changing initializing voltage Vi4 switching subfield from "1" to "2", writing pulse voltage Vd required for stable writing discharge falls by approximately 11 (V). Since then, however, even if the initializing voltage Vi4 switching subfield is enlarged, writing pulse voltage Vd required for generating stable writing discharge hardly changes.

Under the circumstances, in the first embodiment, Vi4L is set to a voltage equal to scan pulse voltage Va, and Vi4H is set to a voltage higher than Vi4L by 10 (V), while the initializing voltage Vi4 switching subfield is set to "2", namely initializing voltage Vi4 is set to Vi4L in 1st SF with the smallest luminance weight and 2nd SF with the second smallest luminance weight; and initializing voltage Vi4 is set to Vi4H in 3rd SF through 10th SF with the largest luminance weight. This setting decreases scan pulse voltage Va and writing pulse voltage Vd required for stable writing. Consequently, scan pulse voltage Va actually applied to scan electrodes SC1 through SCn and writing pulse voltage Vd actually applied to data electrodes D1 though Dm are increased relatively to scan pulse voltage Va and writing pulse voltage Vd required for stable writing, thus implementing stable writing.

The first embodiment does not limit Vi4L, Vi4H, initializing voltage Vi4 switching subfield, structure of a subfield, and others, to the above-described examples, but they are desirably optimized according to characteristics of the panel, specifications of the plasma display apparatus, and others.

Next, a description is made for a method of controlling initializing voltage Vi4 in all-cell initializing operation. To change initializing voltage Vi4, various methods may be used, such as by controlling the down gradient from voltage Vi3 to voltage Vi4 in FIG. 4 to be sharp and gentle to increase and decrease voltage Vi4.

A description is made for an example method of controlling initializing voltage Vi4, according to the first embodiment, using the related drawings. Here, the description is made for a driving waveform in all-cell initializing operation, as an example. However, initializing voltage Vi4 can be controlled in selectively initializing operation as well by the same control method.

Figure 11:
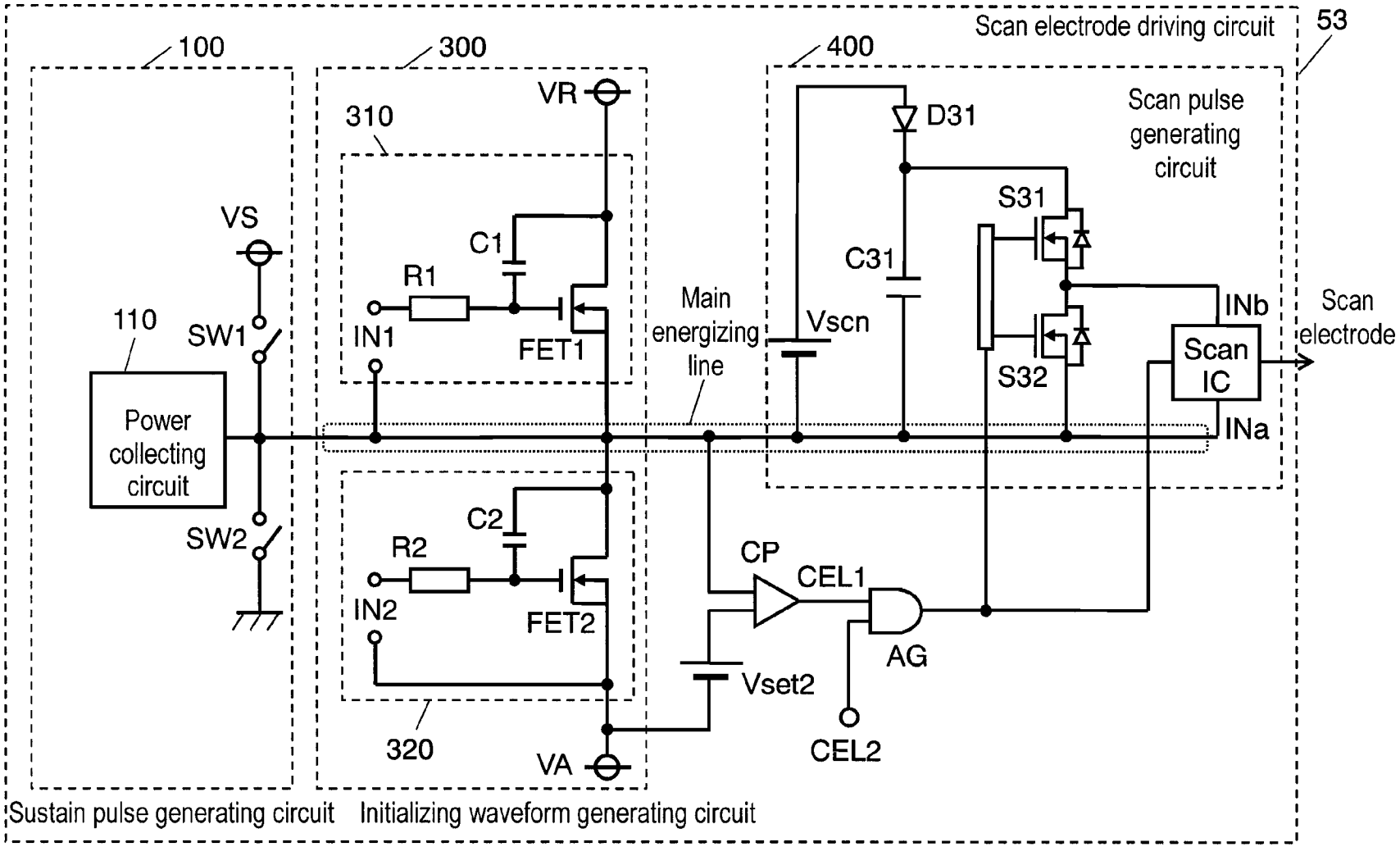
FIG. 11 is a circuit diagram of a scan electrode driving circuit according to the first embodiment of the present invention.

FIG. 11 is a circuit diagram of scan electrode driving circuit 53 according to the first embodiment of the present invention. Scan electrode driving circuit 53 is equipped with sustain pulse generating circuit 100 for generating sustain pulses; initializing waveform generating circuit 300 for generating an initializing waveform; and scan pulse generating circuit 400 for generating scan pulses.

Sustain pulse generating circuit 100 includes power collecting circuit 110 for collecting power for driving scan electrode 22 to reuse the power; switching element SW1 for clamping scan electrode 22 to voltage Vs; and switching element SW2 for clamping scan electrode 22 to 0 (V).

Initializing waveform generating circuit 300, including Miller integrators 310, 320, generates the above-described initializing waveform while controlling initializing voltage Vi4 in all-cell initializing operation. Miller integrator 310, including FET1, capacitor C1, and resistance R1, generates an up ramp waveform voltage gently rising in a ramp shape to voltage Vi2. Miller integrator 320, including FET2, capacitor C2, and resistance R2, generates a down ramp waveform voltage gently falling in a ramp shape to a given initializing voltage Vi4. FIG. 11 indicates input terminals of Miller integrators 310, 320 as input terminals IN1, IN2, respectively.

The first embodiment employs a Miller integrator including an FET, practical and relatively simple in structure, as initializing waveform generating circuit 300, but not limited. Any circuit can be employed that generates up and down ramp waveform voltages.

Scan pulse generating circuit 400, including switching elements S31, S32, and a scan IC, selects either one of a voltage applied to the main energizing line (energizing line commonly connecting sustain pulse generating circuit 100, initializing waveform generating circuit 300, and scan pulse generating circuit 400, shown in broken lines in the drawing); or a voltage gained by superimposing voltage Vscn on the voltage of the main energizing line, to apply to the scan electrode. In a writing period, for example, the voltage of the main energizing line is maintained at negative voltage Va, and either negative voltage Va or voltage Vc gained by superimposing voltage Vscn on negative voltage Va being switched is supplied to the scan IC to generate the above-described negative scan pulse voltage Va.

Here, scan pulse generating circuit 400 directly outputs a voltage waveform from sustain pulse generating circuit 100 in a sustain period. The above-described switching elements and scan IC, composed of generally known elements for switching operation, such as a MOSFET, control switching according to timing signals supplied from timing generating circuit 55.

Scan electrode driving circuit 53 includes AND gate AG for AND operation; and comparator CP for comparing the magnitudes of input signals fed into the two input terminals. Comparator CP compares voltage (Va+Vset2) gained by superimposing voltage Vset2 on voltage Va, with the voltage of the main energizing line, and outputs "0" if the voltage of the main energizing line is higher; and "1", otherwise. AND gate AG is supplied with two signals: output signal CEL1 from comparator CP and switching signal CEL2. A timing signal supplied from timing generating circuit 55, for example, can be employed as switching signal CEL2. Then, AND gate AG outputs "1" if both signals are "1"; and "0", otherwise. An output from AND gate AG is fed into scan pulse generating circuit 400, and scan pulse generating circuit 400 outputs the voltage of the main energizing line if the output from AND gate AG is "0"; the voltage gained by superimposing the voltage Vscn on that of the main energizing line, if "1".

Figure 12:
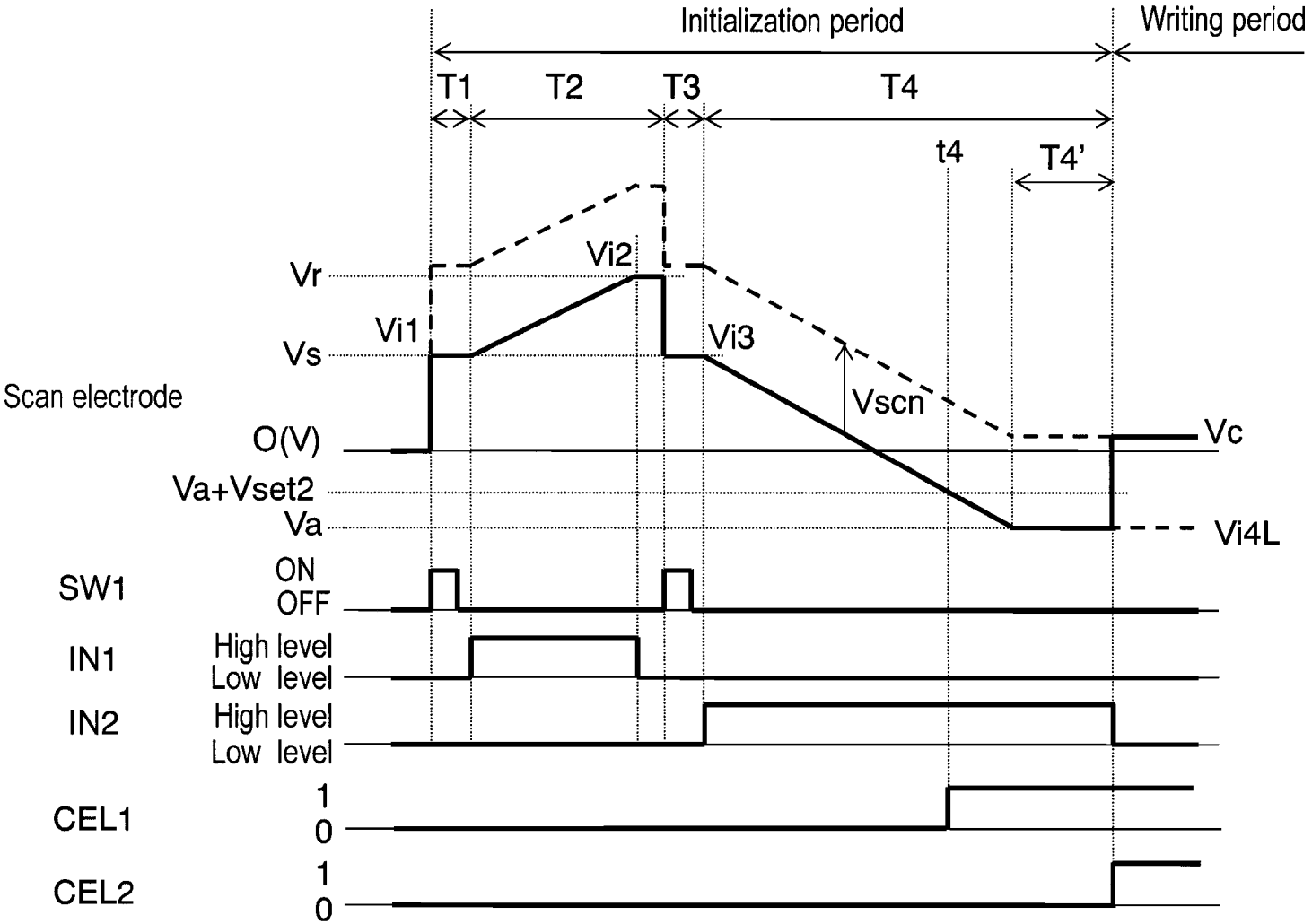
FIG. 12 is a timing diagram for illustrating an example operation of the scan electrode driving circuit in an all-cell initializing operation period, according to the first embodiment of the present invention.
Figure 13:
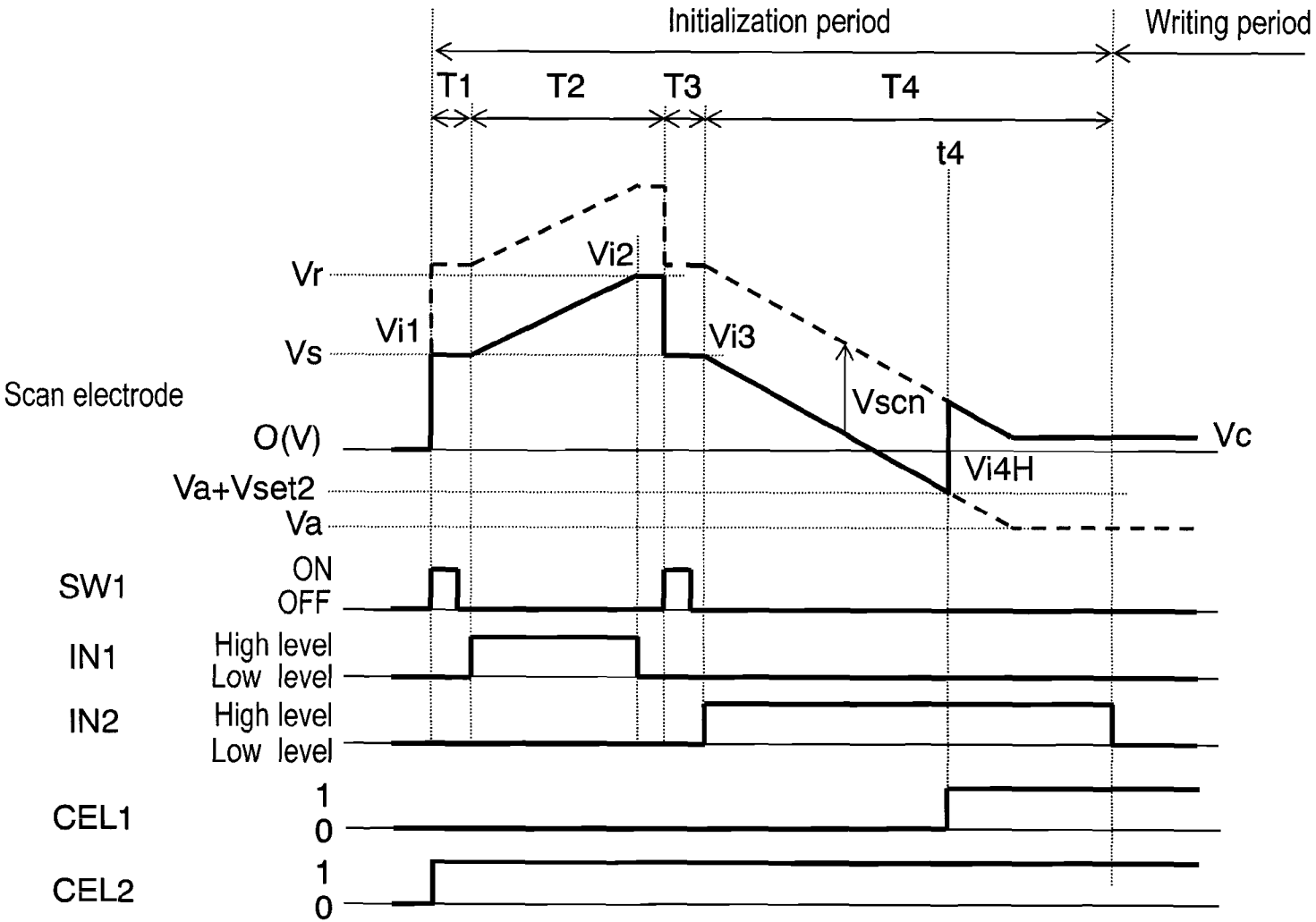
FIG. 13 is a timing diagram for illustrating another example operation of the scan electrode driving circuit in an all-cell initializing operation period, according to the first embodiment of the present invention.

Next, a description is made for the operation of initializing waveform generating circuit 300. First, a case where initializing voltage Vi4 is set to Vi4L is described using FIG. 12, and next, a case where initializing voltage Vi4 is set to Vi4H, using FIG. 13. In FIGS. 12, 13, the description is made for an all-cell initializing operation period, and a down ramp waveform voltage in a selectively initializing period is assumed to be generated in the same operation as that in the description. In FIGS. 12, 13, a drive voltage waveform for all-cell initializing operation is divided into four periods shown by periods T1 through T4, and each period is described. Further, the following assumption is made. That is, voltages Vi1, Vi3, Vi3' are all equal to voltage Vs; voltage Vi4L is equal to negative voltage Va; and voltage Vi4H is equal to voltage (Va+Vset2) gained by superimposing voltage Vset2 on negative voltage Va. Voltage Vi4H is thus higher than scan pulse voltage Va in a writing period. In the following, operation of bringing a switching element into conduction is described as "on"; interruption, as "off".

FIG. 12 is a timing diagram for illustrating an example operation of scan electrode driving circuit 53 in an all-cell initializing operation period, in the first embodiment of the present invention. Here, in order to set initializing voltage Vi4 to Vi4L, switching signal CEL2 is maintained at "0" in periods T1 through T4, and scan pulse generating circuit 400 directly outputs a voltage waveform from initializing waveform generating circuit 300

(Period T1)

First, switching element SW1 of sustain pulse generating circuit 100 is turned on. Then, voltage Vs is applied to scan electrode 22 through switching element SW1. After that, switching element SW1 is turned off.

(Period T2)

Next, input terminal IN1 of Miller integrator 310 is set to "high level". Specifically, voltage 15 (V), for example, is applied to input terminal IN1. Then, a certain amount of current flows from resistance R1 to capacitor C1, the source voltage of FET1 rises in a ramp shape, and the output voltage of scan electrode driving circuit 53 as well starts to rise in a ramp shape, where the voltage rise continues while input terminal IN1 is at "high level".

When the output voltage reaches voltage Vi2, then input terminal IN1 is set to "low level".

An up ramp waveform voltage gently rising from voltage Vs (equal to voltages Vi1, Vi3, Vi3' in the first embodiment), lower than the discharge start voltage, toward Vi2, exceeding the discharge start voltage, is applied to scan electrode 22.

(Period T3)

Next, switching element SW1 of sustain pulse generating circuit 100 is turned on. Then, the voltage of scan electrode 22 falls to voltage Vs, and after that switching element SW1 is turned off.

(Period T4)

Next, input terminal IN2 of Miller integrator 320 is set to "high level". Specifically, voltage 15 (V), for example, is applied to input terminal IN2. Then, a certain amount of current flows from resistance R2 to capacitor C2, the drain voltage of FET2 falls in a ramp shape, and the output voltage from scan electrode driving circuit 53 as well starts to fall in a ramp shape. After the output voltage reaches given negative voltage Vi4, input terminal IN2 is set to "low level".

At this moment, comparator CP is comparing this down ramp waveform voltage (the voltage of the main energizing line) with voltage (Va+Vset2) gained by adding voltage Vset2 to voltage Va, where the output signal from comparator CP changes from "0" to "1" at clock time t4, when the down ramp waveform voltage falls below voltage (Va+Vset2). However, switching signal CEL2 is maintained at "0" in periods T1 through T4, and thus AND gate AG outputs "0". Consequently, scan pulse generating circuit 400 directly outputs this down ramp waveform voltage.

Here, in the first embodiment, after the initialization period ends immediately after the down ramp waveform voltage completely falls to negative voltage Va, the subsequent writing period does not start, but period T4 is set so as to provide period T4' during which negative voltage Va is maintained, namely the initializing waveform is maintained to be flat. This enables the lowest voltage of the down ramp waveform voltage to be measured easily, thus facilitating voltage adjustment of initializing voltage Vi4. Here, in the first embodiment, period T4' is set to approximately 20 μsec, but it is desirably optimized according to characteristics of the panel, specifications of the plasma display apparatus, ease of adjustment, and others.

Scan electrode 22 is thus applied with an up ramp waveform voltage gently rising from voltage Vi1, lower than the discharge start voltage, toward Vi2, exceeding the discharge start voltage, followed by a down ramp waveform voltage gently falling from voltage Vi3 toward initializing voltage Vi4L.

In the subsequent writing period after the initialization period ends, the voltage of the main energizing line is still being maintained at negative voltage Va. This maintains the output signal from comparator CP at "1". In the writing period, switching signal CEL2 is set to "1". Then, both inputs to AND gate AG are "1", and AND gate AG outputs "1". Consequently, scan pulse generating circuit 400 outputs voltage Vc gained by superimposing voltage Vscn on negative voltage Va. Then, as a result that switching signal CEL2 is set to "0" (not illustrated) at timing of generating a negative scan pulse voltage, AND gate AG outputs "0", and scan pulse generating circuit 400 outputs negative voltage Va. In this way, a negative scan pulse voltage in a writing period can be generated.

Next, a description is made for the operation when initializing voltage Vi4 is set to Vi4L using FIG. 13.

FIG. 13 is a timing diagram for illustrating another example operation of scan electrode driving circuit 53 in an all-cell initializing operation period, in the first embodiment of the present invention. Here, in order to set initializing voltage Vi4 to Vi4H, switching signal CEL2 is set to "1" in periods T1 through T4. In FIG. 13, the operation in periods T1 through T3 is the same as that in periods T1 through T3 shown in FIG. 12, and thus period T4 is described.

(Period T4)

In period T4, input terminal IN2 of Miller integrator 320 is set to "high level". Specifically, voltage 15 (V), for example, is applied to input terminal IN2. Then, a certain amount of current flows from resistance R2 to capacitor C2, the drain voltage of FET2 falls in a ramp shape, and the output voltage from scan electrode driving circuit 53 as well starts to fall in a ramp shape. Then, after the output voltage reaches a given negative voltage Vi4, input terminal IN2 is set to "low level".

At this moment, comparator CP is comparing this down ramp waveform voltage (the voltage of the main energizing line) with voltage (Va+Vset2) gained by adding voltage Vset2 to voltage Va, where the output signal from comparator CP changes from "0" to "1" at clock time t4, when the down ramp waveform voltage falls below voltage (Va+Vset2). Then, at this moment, switching signal CEL2 is "1", and thus both inputs to AND gate AG are "1", and AND gate AG outputs "1". As a result, scan pulse generating circuit 400 outputs a voltage gained by superimposing voltage Vscn on the down ramp waveform voltage. Consequently, the lowest-voltage in this down ramp waveform voltage can be set to (Va+Vset2), namely Vi4H.

In the first embodiment, scan electrode driving circuit 53 with the circuitry as shown in FIG. 11 thus enables the lowest voltage of the down ramp waveform voltage gently falling, namely initializing voltage Vi4, to be easily controlled only by setting voltage Vset2 to a desired voltage.

In the first embodiment, the description is made for controlling of initializing voltage Vi4 in all-cell initializing operation. In selectively initializing operation, an up ramp waveform voltage is not generated, but a down ramp waveform voltage is generated in the same way as the above description, as is controlling of initializing voltage Vi4.

In the first embodiment, the description is made for a case where, after the down ramp waveform voltage completely falls below negative voltage Va, period T4' during which the initializing waveform is maintained to be flat is set to approximately 20 μsec. However, a period during which the initializing waveform is maintained to be flat may be dispensed with, namely period T4' may be "0".

Second Exemplary Embodiment

Figure 14:
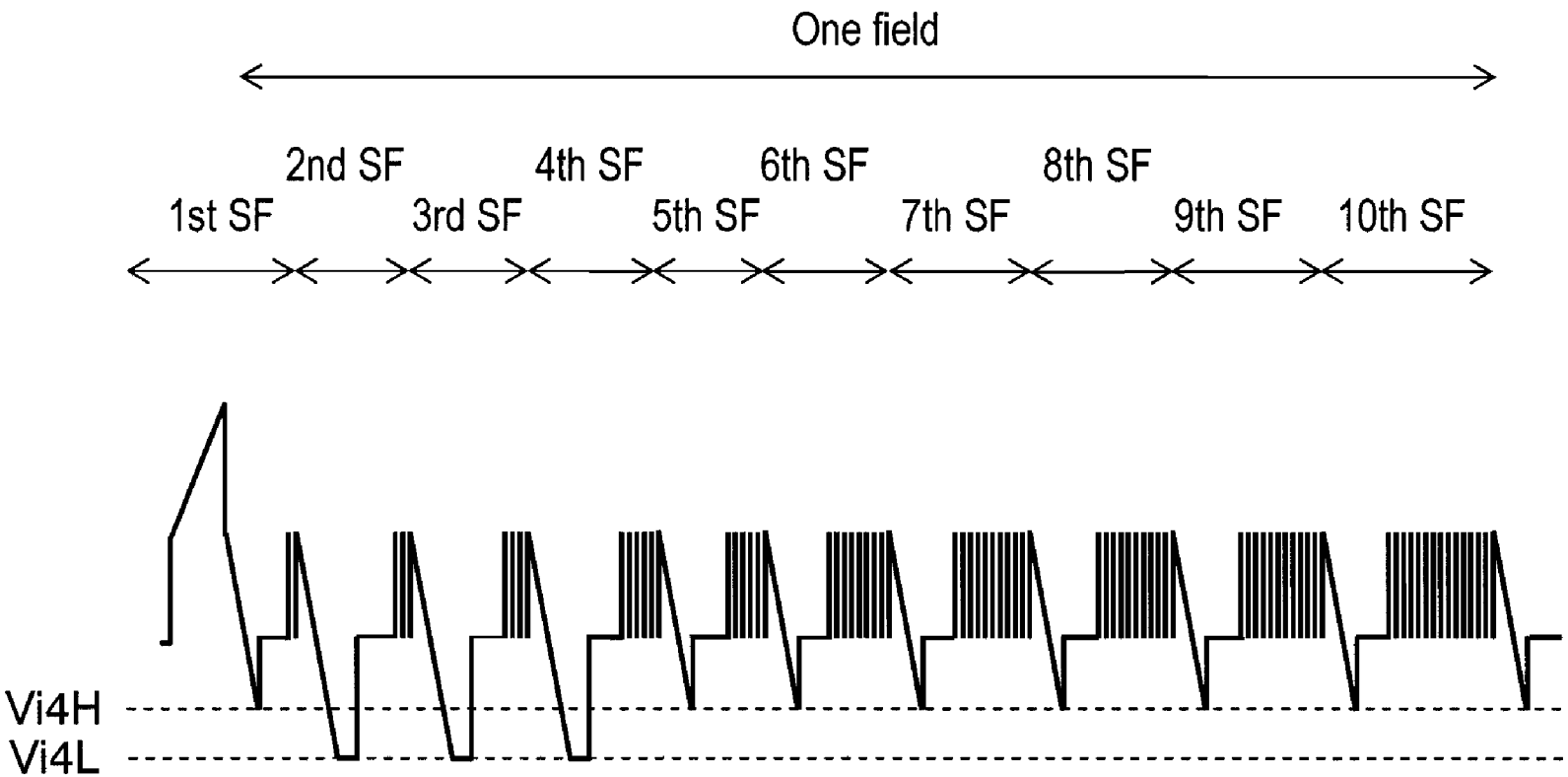
FIG. 14 illustrates the structure of a subfield according to the second exemplary embodiment of the present invention.

FIG. 14 is the structure of a subfield in the second embodiment of the present invention. The structure of a subfield in the second embodiment is different from that in the first one in that initializing voltage Vi4 in 1st SF is set to Vi4H. In the second embodiment, initializing voltage Vi4 in subsequent 2nd SF through fourth SF is set to Vi4L; and in the remaining subfields, to Vi4H. The reason is described below.

In recent years, with an increase in size and finer resolution of panel 10, a higher image quality has been desired. Effective means for implementing higher image quality include higher luminance and higher gradation. For instance, increasing the total number of sustain pulses in one field period facilitates higher luminance; the number of subfields in one field period, higher gradation.

However, with the structure of a subfield in these methods, the ratio of time used for driving panel 10 to one single field period increases as the number of sustain pulses and/or subfields increases. This results in shortening time period during which driving is not performed, such as time after the last subfield ends until the first subfield of the subsequent field starts.

The present inventor acknowledges that initializing discharge occurs early when a large number of sustain discharges occur in the sustain period of the immediately preceding subfield, and additionally when the time interval after the sustain period ends until the initialization period of the subsequent subfield starts is short. This is possibly because a large amount of priming particles occur as a result of a large number of sustain discharges in the immediately preceding sustain period and additionally because the subsequent initializing operation starts with these priming particles excessively remaining.

Initializing operation works as adjusting wall charge so that subsequent writing discharge will normally occur. For this reason, initializing discharge needs to be generated at an appropriate discharge intensity and for appropriate duration time. However, early initializing discharge prolongs the duration time of initializing discharge accordingly, causing initializing defects such as excessively weakened wall voltage, which can result in unstable writing discharge subsequent to the initializing discharge.

Consequently, if a large number of sustain discharges occur in the sustain period of the immediately preceding subfield, and additionally if the time interval after the sustain period ends until the initialization period of the subsequent subfield starts is short, initializing discharge is expected to occur early, and thus initializing voltage Vi4 needs to be set so that the duration time of initializing discharge will not be too long.

That is, the second embodiment shows the structure of a subfield in a case where the time interval after the last subfield ends until the subsequent 1st SF starts is shortened as a result that the total number of sustain pulses in one single field period is increased to facilitate higher luminance or that the number of subfields is increased to facilitate higher gradation. As shown in FIG. 14, initializing voltage Vi4 in 1st SF is set to Vi4H; in 2nd SF through fourth SF, to Vi4L.

For a subfield structure where the time interval after the last subfield ends until subsequent 1st SF starts is shortened, initializing voltage Vi4 in 1st SF is thus desirably set to Vi4H, thereby implementing stable writing.

In the second embodiment, an example where initializing voltage Vi4 in 2nd SF through fourth SF is set to Vi4L. However, in which subfields after 2nd SF (included) initializing voltage Vi4 is set to Vi4L could be optimized according to specifications of the plasma display apparatus and characteristics of the panel.

In the first and second embodiments of the present invention, the partial pressure of xenon in discharge gas is 10%, but drive voltage appropriate to the panel could be set for other partial pressures.

In the first and second embodiments of the present invention, concrete numeric values are used by way of example only. Optimum values are desirably set as appropriate in accordance with characteristics of the panel, specifications of the plasma display apparatus, and others.

INDUSTRIAL APPLICABILITY

The method of driving a panel and the plasma display apparatus of the present invention generates stable writing discharge without increasing voltage required for generating writing discharge even for a large-screen, high-luminance panel, thus useful as a method of driving a panel and a plasma display apparatus with high quality of image display.

The invention claimed is:

1. A method of driving a plasma display panel that displays an image, comprising: providing a plurality of subfields in a field period, wherein each subfield includes:

an initialization period during which a gently falling gradient waveform voltage is applied to a scan electrode;

a writing period during which a scan pulse voltage is applied to the scan electrode to generate writing discharge in a discharge cell including a display electrode pair including the scan electrode and a sustain electrode; and a sustain period during which a sustain pulse voltage is alternately applied, to the display electrode pair, a number of times corresponding to a luminance weight to generate a sustain discharge in the discharge cell in which the writing discharge is generated during the writing period, and wherein the plasma display panel is driven so that a lowest voltage of the gradient waveform voltage in the initialization period in a subfield other than a subfield with a largest luminance weight is lower than a lowest voltage of the gradient waveform voltage in the initialization period in the subfield with the largest luminance weight, wherein the initialization period of a subfield with a smallest luminance weight is an all-cell initializing subfield in which all discharge cells are made to generate initializing discharge, and wherein the initialization period of the subfield with the largest luminance weight is a selectively initializing subfield in which an initializing discharge is generated selectively in the discharge cell in which the sustain discharge has been generated in an immediately preceding subfield.

2. The method of driving a plasma display panel of claim 1, wherein the plasma display panel is driven so that a lowest voltage of the gradient waveform voltage in the initialization period in a subfield with a smallest luminance weight is lower than the lowest voltage of the gradient waveform voltage in the initialization period in the subfield with the largest luminance weight.

3. The method of driving a plasma display panel of claim 1, wherein the plasma display panel is driven so that the lowest voltage of the gradient waveform voltage in the initialization period in the subfield with the largest luminance weight is higher than the scan pulse voltage in the subfield with the largest luminance weight.

4. A method of driving a plasma display panel that displays an image, comprising:

providing a plurality of subfields in a field period wherein each subfield includes:

an initialization period during which a gently falling gradient waveform voltage is applied to a scan electrode;

a writing period during which a scan pulse voltage is applied to the scan electrode to generate writing discharge in a discharge cell including a display electrode pair including the scan electrode and a sustain electrode; and a sustain period during which a sustain pulse voltage is alternately applied, to the display electrode pair, a number of times corresponding to a luminance weight to generate a sustain discharge in the discharge cell in which the writing discharge is generated during the writing period, and wherein the plasma display panel is driven so that a lowest voltage of the gradient waveform voltage in the initialization period in a subfield other than a subfield with a largest luminance weight is lower than a lowest voltage of the gradient waveform voltage in the initialization period in the subfield with the largest luminance weight, wherein the plasma display panel is driven so that a lowest voltage of the gradient waveform voltage in the initialization period in a subfield with a second smallest luminance weight is lower than the lowest voltage of the gradient waveform voltage in the initialization period in the subfield with the largest luminance weight.

5. A plasma display apparatus comprising:

a plasma display panel including a plurality of discharge cells, each having a display electrode pair including a scan electrode and a sustain electrode; and a driving circuit driving the plasma display panel by providing a plurality of subfields in one field period, wherein each subfield includes:

an initialization period during which a gently falling gradient waveform voltage is applied to the scan electrode;

a writing period during which writing discharge is generated in a discharge cell from among the plurality of discharge cells; and a sustain period during which sustain pulse voltage is alternately applied, to the display electrode pair of the discharge cell in which the writing discharge is generated during the writing period, a number of times corresponding to a luminance weight to generate a sustain discharge in the discharge cell in which the writing discharge is generated during the writing period, and wherein the driving circuit drives the plasma display panel so that a lowest voltage of the gradient waveform voltage in the initialization period in a subfield other than a subfield with a largest luminance weight is lower than a lowest voltage of the gradient waveform voltage in the initialization period in the subfield with the largest luminance weight, wherein the initialization period of a subfield with a smallest luminance weight is an all-cell initializing subfield in which all discharge cells are made to generate initializing discharge, and wherein the initialization period of the subfield with the largest luminance weight is a selectively initializing subfield in which an initializing discharge is generated selectively in the discharge cell in which the sustain discharge has been generated in an immediately preceding subfield.

6. A plasma display apparatus comprising:

a plasma display panel including a plurality of discharge cells, each having a display electrode pair including a scan electrode and a sustain electrode; and a driving circuit driving the plasma display panel by providing a plurality of subfields in one field period, wherein each subfield includes:

an initialization period during which a gently falling gradient waveform voltage is applied to the scan electrode;

a writing period during which writing discharge is generated in a discharge cell from among the plurality of discharge cells; and a sustain period during which sustain pulse voltage is alternately applied, to the display electrode pair of the discharge cell in which the writing discharge is generated during the writing period, a number of times corresponding to a luminance weight to generate a sustain discharge in the discharge cell in which the writing discharge is generated during the writing period, wherein the driving circuit drives the plasma display panel so that a lowest voltage of the gradient waveform voltage in the initialization period in a subfield other than a subfield with a largest luminance weight is lower than a lowest voltage of the gradient waveform voltage in the initialization period in the subfield with the largest luminance weight, and wherein the plasma display panel is driven so that a lowest voltage of the gradient waveform voltage in the initialization period in a subfield with a second smallest luminance weight is lower than the lowest voltage of the gradient waveform voltage in the initialization period in the subfield with the largest luminance weight.

* * * * *